US011885054B2

(12) United States Patent
Minematsu et al.

(10) Patent No.: US 11,885,054 B2
(45) Date of Patent: Jan. 30, 2024

(54) SEWING SYSTEM AND SEWING MACHINE

(71) Applicant: BROTHER KOGYO KABUSHIKI KAISHA, Nagoya (JP)

(72) Inventors: Yoshihiro Minematsu, Nagoya (JP); Tsuneo Okuyama, Inabe (JP); Masahiro Hanabusa, Nagoya (JP); Kazuki Shibata, Nagoya (JP); Satomi Yamamoto, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 238 days.

(21) Appl. No.: 17/559,933

(22) Filed: Dec. 22, 2021

(65) Prior Publication Data

US 2022/0112641 A1 Apr. 14, 2022

Related U.S. Application Data

(63) Continuation of application No. PCT/JP2020/012282, filed on Mar. 19, 2020.

(30) Foreign Application Priority Data

Jul. 8, 2019 (JP) ..... 2019-126625

(51) Int. Cl.
*D05B 19/04* (2006.01)
*D05C 5/06* (2006.01)
*D05B 21/00* (2006.01)

(52) U.S. Cl.
CPC ..... *D05B 19/04* (2013.01); *D05B 21/00* (2013.01); *D05C 5/06* (2013.01)

(58) Field of Classification Search
CPC ..... D05B 19/02; D05B 19/04; D05B 19/08; D05B 19/10; D05B 19/16; D05B 21/00; D05C 5/06; D05C 5/02
See application file for complete search history.

(56) References Cited

U.S. PATENT DOCUMENTS 8,091,493 B2 * 1/2012 Tokura ..... D05B 19/10 112/470.01
8,539,893 B2 * 9/2013 Tokura ..... D05C 5/04 112/102.5

(Continued)

FOREIGN PATENT DOCUMENTS

JP 2009-174981 A 8/2009
JP 2014-155578 A 8/2014

(Continued)

OTHER PUBLICATIONS

Jun. 23, 2020 International Search Report issued in International Patent Application No. PCT/JP2020/012282.

(Continued)

*Primary Examiner* — Danny Worrell
(74) *Attorney, Agent, or Firm* — Oliff PLC

(57) ABSTRACT

The sewing system includes a device and a sewing machine including a movement mechanism to move an embroidery frame. The device identifies reference point coordinates representing a position of a reference point provided in a range prescribed by an inner frame of the embroidery frame and transmits the reference point coordinates to the sewing machine. The sewing machine notifies a notification position, using a notification portion, with respect to the range prescribed by the inner frame and acquires a relative movement amount of the embroidery frame with respect to the notification portion, for aligning the notification position and the reference point provided in the range prescribed by the inner frame. The sewing machine decides, on the basis of a relationship between the movement amount and the reference point coordinates, a deviation from a prescribed state of a positional relationship between the inner frame and the movement mechanism.

24 Claims, 15 Drawing Sheets

(56) References Cited

U.S. PATENT DOCUMENTS

| | | | | |
|---|---|---|---|---|
| 8,869,721 | B2 * | 10/2014 | Suzuki | D05B 19/16 112/102.5 |
| 9,127,383 | B2 * | 9/2015 | Yamanashi | D05C 5/02 |
| 9,938,650 | B2 * | 4/2018 | Kongo | D05B 19/02 |
| 10,017,889 | B2 * | 7/2018 | Kongo | D05C 5/04 |
| 10,019,813 | B2 * | 7/2018 | Kongo | G06T 7/0004 |
| 10,597,806 | B2 * | 3/2020 | Imaizumi | D05C 5/06 |
| 2009/0188415 | A1 | 7/2009 | Tokura | |
| 2014/0230706 | A1 | 8/2014 | Suzuki et al. | |
| 2017/0306542 | A1 | 10/2017 | Kongo | |
| 2017/0316580 | A1 | 11/2017 | Kongo | |

FOREIGN PATENT DOCUMENTS

| | | | |
|---|---|---|---|
| JP | 2015-62560 | A | 4/2015 |
| JP | 2017-196066 | A | 11/2017 |
| JP | 2017-196334 | A | 11/2017 |

OTHER PUBLICATIONS

Jan. 11, 2022 International Preliminary Report issued in International Application No. PCT/JP2020/012282.

* cited by examiner

| SCHEMATIC DRAWING OF INNER FRAME | |  |  |  |
|---|---|---|---|---|
| ID | | 1 | 2 | 3 |
| NUMBER OF PATTERNS | | 1 | 2 | 3 |
| FRAME MARKER | 151 | (X41, Y41) | (X51, Y51) | (X61, Y61) |
| | 152 | (X42, Y42) | (X52, Y52) | (X62, Y62) |
| | 153 | (X43, Y43) | (X53, Y53) | (X63, Y63) |
| | 154 | (X44, Y44) | (X54, Y54) | (X64, Y64) |
| SURPLUS AREA | Q1 | (X71, Y71) | (X81, Y81) | (X91, Y91) |
| | Q2 | (X72, Y72) | (X82, Y82) | (X92, Y92) |
| | Q3 | (X73, Y73) | (X83, Y83) | (X93, Y93) |
| | Q4 | (X74, Y74) | (X84, Y84) | (X94, Y94) |

| SCHEMATIC DRAWING OF INNER FRAME | |  |  |  |
|---|---|---|---|---|
| ID | | 1 | 2 | 3 |
| SEWABLE AREA | P1 | (X11, Y11) | (X21, Y21) | (X31, Y31) |
| | P2 | (X12, Y12) | (X22, Y22) | (X32, Y32) |
| | P3 | (X13, Y13) | (X23, Y23) | (X33, Y33) |
| | P4 | (X14, Y14) | (X24, Y24) | (X34, Y34) |

SEWING SYSTEM AND SEWING MACHINE

CROSS-REFERENCE TO RELATED APPLICATION

This application is a Continuing Application of International Application No. PCT/JP2020/012282, filed Mar. 19, 2020, which claims priority from Japanese Patent Application No. 2019-126625, filed on Jul. 8, 2019. This disclosure of the foregoing application is hereby incorporated by reference in its entirety.

BACKGROUND

The present disclosure relates to a sewing system and a sewing machine.

In known art, a sewing machine includes a function for sewing an embroidery pattern on a sewing object. The sewing object is clamped between an inner frame and an outer frame of an embroidery frame. The sewing machine holds and moves the outer frame of the embroidery frame, and controls a relative positional relationship of the sewing object with respect to a sewing needle. As a result of the above processing, the sewing of the embroidery pattern is performed. A mobile terminal includes a camera.

Of the sewing object clamped in the embroidery frame, a user adheres an indication marker to a position at which the embroidery pattern is to be sewn. Next, using the camera of the mobile terminal, the user includes a reference marker provided on the inner frame of the embroidery frame, and the indication marker adhered to the sewing object inside an imaging range and captures the range. The mobile terminal generates image data using the captured image. On the basis of the image data, the mobile terminal calculates, as arrangement data, a position and an angle of the indication marker with respect to the reference marker. The mobile terminal transmits the calculated arrangement data to the sewing machine. The sewing machine receives the arrangement data transmitted from the mobile terminal. On the basis of the received arrangement data, the sewing machine determines a sewing position of the embroidery pattern with respect to the sewing object. By moving the outer frame of the embroidery frame with which the sewing object is clamped, the sewing machine sews the embroidery pattern at the determined sewing position.

SUMMARY

When causing the sewing object to be clamped by the embroidery frame, a distance between the inner frame and the outer frame of the embroidery frame changes due to the thickness of the sewing object to be clamped. In other words, when the thick sewing object is clamped in the embroidery frame, the distance between the inner frame and the outer frame becomes larger, and when the thin sewing object is clamped in the embroidery frame, the distance between the inner frame and the outer frame becomes smaller. Further, the distance between the inner frame and the outer frame may change due to a manufacturing error of the embroidery frame.

Since the sewing machine holds the outer frame of the embroidery frame and moves the embroidery frame, for example, when the embroidery pattern is sewn in accordance with the arrangement data for the embroidery pattern to be sewn in the center of the inner frame, the embroidery pattern ends up being sewn in a position deviated from the center of the inner frame by an amount corresponding to the thickness of the sewing object. The thicker the sewing object, the greater the deviation.

In this case, in order for the sewing machine to sew the embroidery pattern at an appropriate position on the sewing object on the basis of the arrangement data, it is necessary to identify a deviation in a positional relationship between the inner frame and the outer frame of the embroidery frame. However, in the above-described sewing machine system, there is a problem that the deviation in the positional relationship between the inner frame and the outer frame of the embroidery frame, that is, the deviation in the positional relationship between the inner frame and a movement mechanism holding the outer frame, cannot be identified.

An objective of the present disclosure is to provide a sewing system and a sewing machine capable of identifying a deviation in a positional relationship between an inner frame of an embroidery frame and a movement mechanism holding an outer frame.

A sewing system according to a first aspect of the present disclosure includes a device and a sewing machine. The device includes an image sensor. The sewing machine includes a movement mechanism that is configured to hold and move an outer frame of an embroidery frame in a state in which a sewing object is clamped between the outer frame and an inner frame of the embroidery frame. The sewing machine is configured to sew an embroidery pattern on the sewing object. The device includes a processor and a memory storing computer-readable instructions that, when executed by the processor, cause the processor to perform following processes. The processor of the device identifies, on the basis of an image when the embroidery frame is captured by the image sensor, reference point coordinates representing a position of a reference point provided in a range prescribed by the inner frame, and transmits, to the sewing machine, first data including the identified reference point coordinates. The sewing machine includes a processor and a memory storing computer-readable instructions that, when executed by the processor, cause the processor to perform following processes. The processor of the sewing machine receives the first data transmitted by the device, and notifies a notification position, using a notification portion, with respect to the range prescribed by the inner frame of the embroidery frame held by the movement mechanism. The processor of the sewing machine acquires a relative movement amount of the embroidery frame with respect to the notification portion, for aligning the notified notification position and the position of the reference point provided in the range prescribed by the inner frame of the embroidery frame in the state of being held by the movement mechanism. And the processor of the sewing machine decides, on the basis of a relationship between the acquired movement amount and the reference point coordinates included in the first data received from the device, a deviation from a prescribed state of a positional relationship between the inner frame of the embroidery frame and the movement mechanism holding the outer frame.

A sewing system capable of sewing an embroidery pattern on a sewing object according to a second aspect of the present disclosure includes an image sensor, a movement mechanism, a processor, and a memory. The movement mechanism is configured to hold and move an outer frame of an embroidery frame in a state in which the sewing object is clamped between the outer frame and an inner frame of an embroidery frame. The memory stores computer-readable instructions that, when executed by the processor, cause the processor to perform following processes. The processor identifies, on the basis of an image when the embroidery frame is captured by the image sensor, reference point coordinates representing a position of a reference point provided in a range prescribed by the inner frame, and notifies a notification position, using a notification portion, with respect to the range prescribed by the inner frame of the embroidery frame held by the movement mechanism. The processor acquires a relative movement amount of the embroidery frame with respect to the notification portion, for aligning the notified notification position and the position of the reference point provided in the range prescribed by the inner frame of the embroidery frame in the state of being held by the movement mechanism. The processor also decides, on the basis of a relationship between the acquired movement amount and the identified reference point coordinates, a deviation from a prescribed state of a positional relationship between the inner frame of the embroidery frame and the movement mechanism holding the outer frame.

A sewing machine capable of sewing an embroidery pattern on a sewing object according to a third aspect of the present disclosure includes a movement mechanism, a processor, and a memory. The movement mechanism is configured to hold and move an outer frame of an embroidery frame in a state in which the sewing object is clamped between the outer frame and an inner frame of the embroidery frame. The memory stores computer-readable instructions that, when executed by the processor, cause the processor to perform following processes. The processor acquires reference point coordinates representing a position of a reference point provided in a range prescribed by the inner frame of the embroidery frame, and notifies a notification position, using a notification portion, with respect to the range prescribed by the inner frame of the embroidery frame held by the movement mechanism. The processor acquires a relative movement amount of the embroidery frame with respect to the notification portion, for aligning the notified notification position and the position of the reference point provided in the range prescribed by the inner frame of the embroidery frame in the state of being held by the movement mechanism. The processor also decides, on the basis of a relationship between the acquired movement amount and the acquired reference point coordinates, a deviation from a prescribed state of a positional relationship between the inner frame of the embroidery frame and the movement mechanism holding the outer frame.

BRIEF DESCRIPTION OF THE DRAWINGS

Embodiments of the disclosure will be described below in detail with reference to the accompanying drawings in which.

DETAILED DESCRIPTION

Embodiments embodying the present disclosure will be described in order with reference to the drawings. The drawings to be referenced are used to illustrate the technical features that can be adopted in the present disclosure, and the described structures and the like of the devices are merely explanatory examples.

Figure 1:
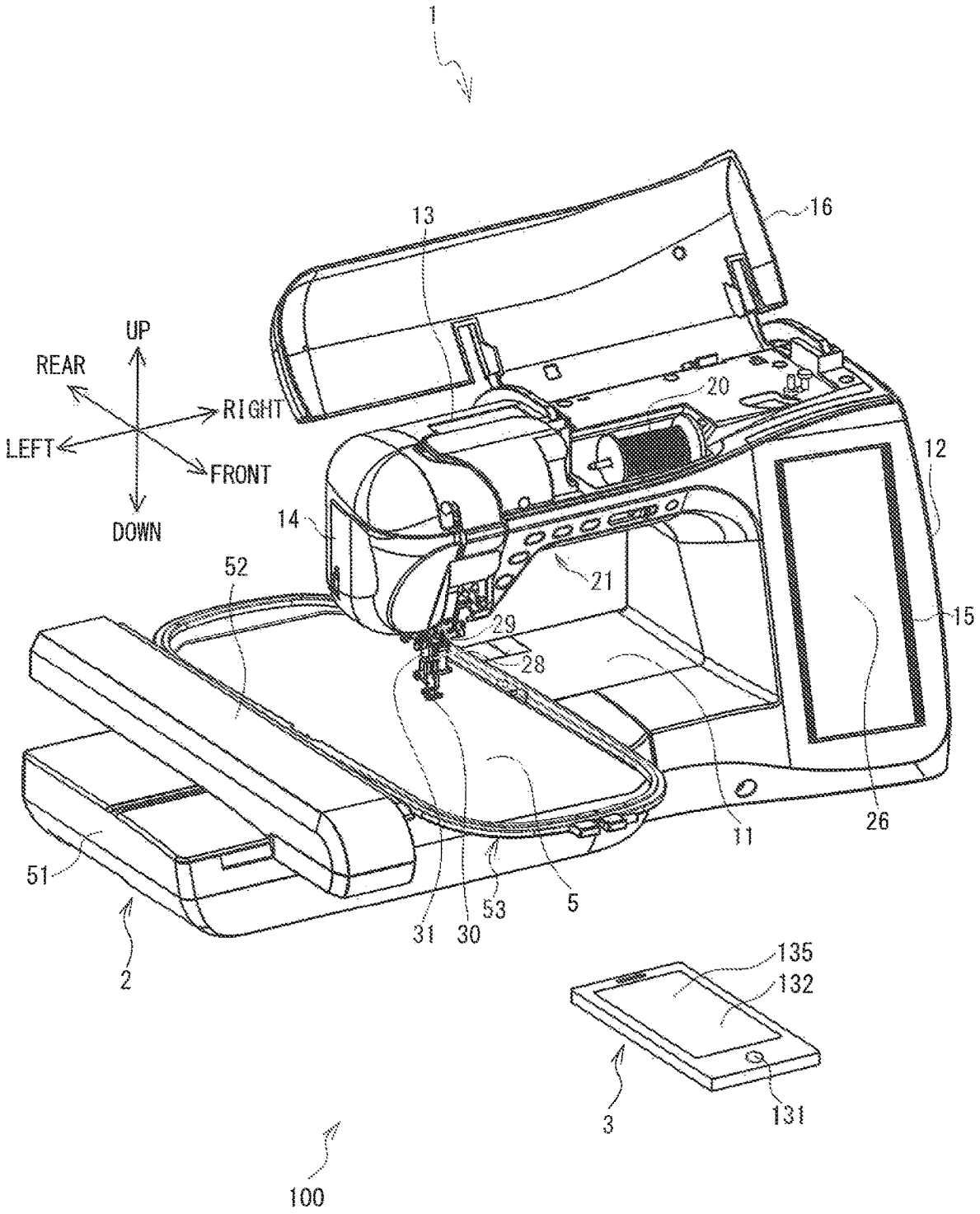
FIG. 1 is a perspective view of a sewing system 100 provided with a sewing machine 1, and a mobile terminal 3.

A sewing system 100 will be explained with reference to FIG. 1 to FIG. 6. As shown in FIG. 1, the sewing system 100 is provided with a sewing machine 1 and a mobile terminal 3. The sewing machine 1 and the mobile terminal 3 are each capable of connecting to a network 9 (a local area network, for example) shown in FIG. 5. In the following explanation, the upper side, the lower side, the lower left side, the upper right side, the upper left side, and the lower right side in FIG. 1 respectively correspond to the upper side, the lower side, the left side, the right side, the rear side, and the front side of the sewing machine 1 and the mobile terminal 3.

Configuration of Sewing Machine 1

The sewing machine 1 is provided with functions to sew an embroidery pattern. As shown in FIG. 1, the sewing machine 1 is provided with a bed 11, a pillar 12, and an arm 13. The bed 11 is a base of the sewing machine 1 and extends in the left-right direction. The pillar 12 extends upward from the right end portion of the bed 11. The arm 13 extends to the left from the upper end of the pillar 12, so as to face the bed 11. The left end portion of the arm 13 is a head 14.

A feed dog (not shown in the drawings), a conveyance mechanism 85 (refer to FIG. 5), a conveyance motor 80 (refer to FIG. 5), and a shuttle mechanism (not shown in the drawings) are provided inside the bed 11. The feed dog is driven by the conveyance mechanism 85 and conveys a sewing object in a predetermined conveyance direction (the front-rear direction of the sewing machine 1). The sewing object is, for example, a processing cloth. The conveyance mechanism 85 is a mechanism that drives the feed dog in the up-down direction and the front-rear direction. The shuttle mechanism forms stitches in the sewing object in conjunction with a sewing needle 28 mounted on the lower end of a needle bar 29. The conveyance motor 80 is a pulse motor that drives the conveyance mechanism 85.

A known embroidery device 2 that is used in embroidery sewing can be mounted on and detached from the bed 11. When the embroidery device 2 is mounted on the sewing machine 1, the embroidery device 2 and the sewing machine 1 are electrically connected. When the embroidery device 2 and the sewing machine 1 are electrically connected, the embroidery device 2 can convey a sewing object 5 held by the embroidery frame 53. The embroidery device 2 is provided with a main body portion 51, and a carriage 52.

The carriage 52 is provided above the main body portion 51. The carriage 52 is provided with a frame holder (not shown in the drawings), a Y-axis conveyance mechanism 88 (refer to FIG. 5), and a Y-axis motor 83 (refer to FIG. 5). The embroidery frame 53 is detachably mounted on the frame holder. A plurality of types of the embroidery frame 53 are prepared in which at least one of the size and the shape differ. The frame holder is provided on a right side surface of the carriage 52. The sewing object 5 held by the embroidery frame 53 is disposed above the bed 11, and below the needle bar 29 and a presser foot 30. The Y-axis conveyance mechanism 88 conveys the frame holder in the front-rear direction (a Y direction). As a result of the frame holder being conveyed in the front-rear direction, the embroidery frame 53 conveys the sewing object 5 in the front-rear direction. The Y-axis motor 83 drives the Y-axis conveyance mechanism 88. A CPU 61 (refer to FIG. 5) of the sewing machine 1 controls the Y-axis motor 83 in accordance with coordinate data.

Figure 5:
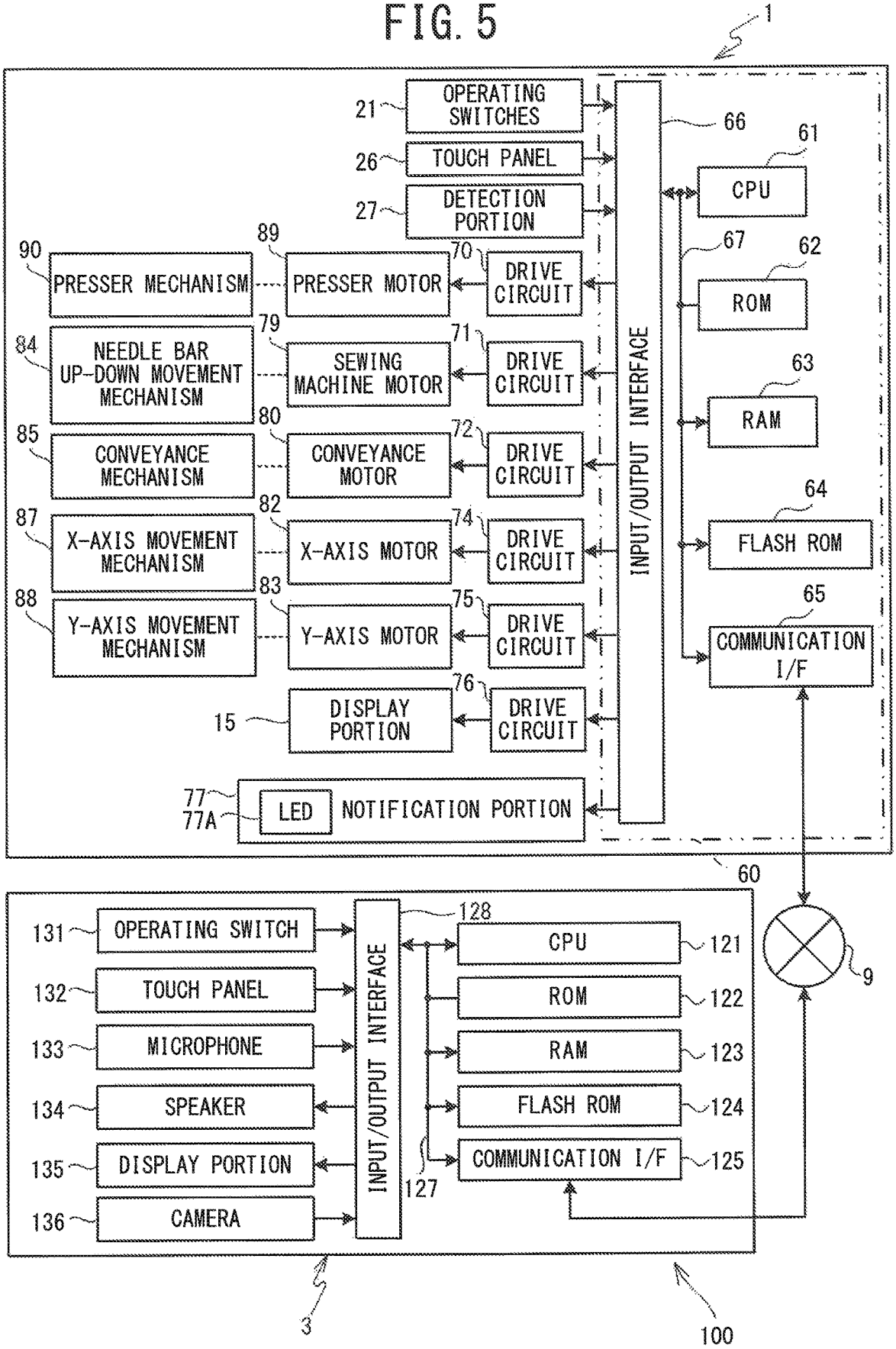
FIG. 5 is a block diagram showing an electrical configuration of the sewing system 100.

The main body portion 51 is provided, internally, with an X-axis conveyance mechanism 87 (refer to FIG. 5) that conveys the carriage 52 in the left-right direction (an X direction), and an X-axis motor 82 (refer to FIG. 5). The embroidery frame 53 conveys the sewing object 5 in the left-right direction as a result of the carriage 52 being conveyed in the left-right direction. The X-axis motor 82 drives the X-axis conveyance mechanism 87. The CPU 61 of the sewing machine 1 controls the X-axis motor 82 in accordance with the coordinate data.

A display portion 15 is provided on the front surface of the pillar 12. The display portion 15 is a liquid crystal display. A screen including various items, such as commands, illustrations, setting values, messages, and the like, is displayed on the display portion 15. A touch panel 26 that can detect a pressed position is provided on a front surface side of the display portion 15. When the user performs an operation to press the touch panel 26 using a finger or a dedicated touch pen, the pressed position is detected by the touch panel 26. Then, on the basis of the detected pressed position, it is recognized which of the items displayed on the display portion 15 has been selected. Hereinafter, the operation to press the touch panel 26 by the user is referred to as a panel operation.

A cover 16 that can be opened and closed is provided on an upper portion of the arm 13. In FIG. 1, the cover 16 is shown in an open state. A thread spool 20 is accommodated below the cover 16, that is, substantially in a center portion inside the arm 13. An upper thread (not shown in the drawings) wound around the thread spool 20 is supplied to, from the thread spool 20, the sewing needle 28 mounted on the needle bar 29, via a thread guard (not shown in the drawings) provided on the head 14. A plurality of operating switches 21, including a start/stop switch, are provided on a lower portion of the front surface of the arm 13.

A presser mechanism 90 (refer to FIG. 5), a needle bar up-down movement mechanism 84 (refer to FIG. 5), and the like are provided inside the head 14. The presser mechanism 90 drives a presser bar 31, using a presser motor 89 (refer to FIG. 5) as a driving source. The needle bar up-down movement mechanism 84 drives the needle bar 29 in the up-down direction in accordance with the rotation of a drive shaft (not shown in the drawings). The needle bar up-down movement mechanism 84 is driven by a sewing machine motor 79 (refer to FIG. 5). The needle bar 29 and the presser bar 31 extend downward from the lower end portion of the head 14. The sewing needle 28 is detachably mounted on the lower end of the needle bar 29. The presser foot 30 is detachably mounted on the lower end of the presser bar 31. The presser foot 30 can press the sewing object 5 from above such that the sewing object 5 can be conveyed.

A notification portion 77 (refer to FIG. 5) is provided on the lower end portion of the head 14. The notification portion 77 includes an LED light source 77A (refer to FIG. 5). The notification portion 77 can downwardly emit light having high directivity irradiated from the LED light source 77A. The notification portion 77 can notify a position of a needle drop point. When the sewing needle 28 that is disposed directly above a needle hole (not shown in the drawings) is moved downward, the needle drop point is a point at which the sewing needle 28 pierces, from above, the sewing object 5 placed on the bed 11. Hereinafter, a position, of the sewing object 5 placed on the bed 11, onto which the light emitted from the LED light source 77A of the notification portion 77 is irradiated is referred to as a "notification position." The notification position is aligned with the needle drop point.

Embroidery Frame 53

Figure 2:
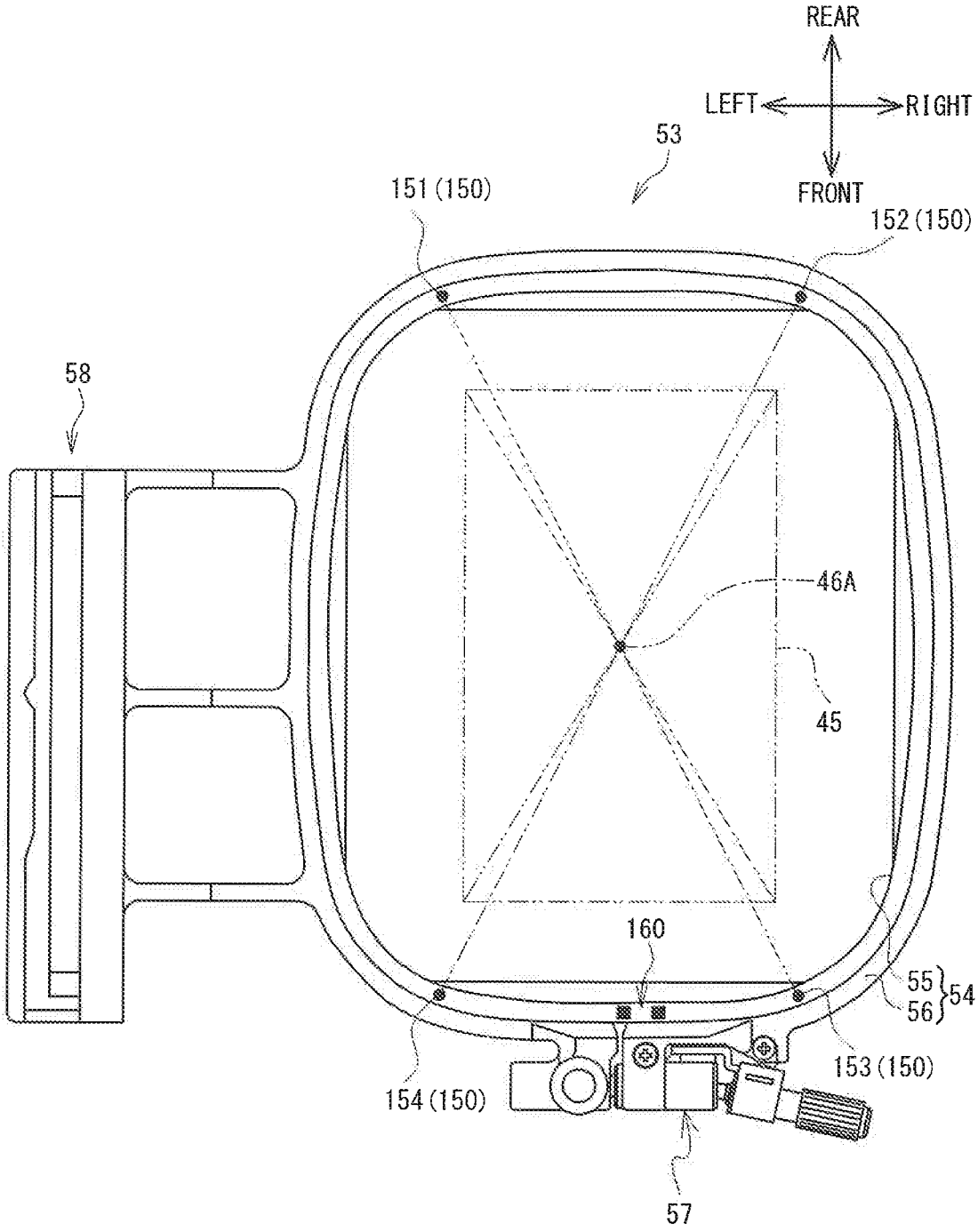
FIG. 2 is a plan view of an embroidery frame 53.

A physical configuration of the embroidery frame 53 will be explained with reference to FIG. 2. The upper side, the lower side, the left side, the right side, a depth side, and a front side of FIG. 2 respectively correspond to a rear side, a front side, a left side, a right side, a lower side, and an upper side of the embroidery frame 53.

The embroidery frame 53 includes a clamping portion 54 and a mounting portion 58. The clamping portion 54 is provided with an inner frame 55 and an outer frame 56. The inner frame 55 and the outer frame 56 are portions that clamp the sewing object 5. The inner frame 55 and the outer frame 56 are, respectively, long in the front-rear direction, and are substantially rectangular frame members with rounded corners. An inner periphery of the outer frame 56 is substantially the same shape as an outer periphery of the inner frame 55. The inner frame 55 detachably fits inside the outer frame 56. A cut portion 57, at which the outer frame 56 is divided at a central portion in the lengthwise direction, is provided in the side on the front side of the outer frame 56. A tightening mechanism that tightens the outer frame 56 with respect to the inner frame 55 is provided at the cut portion 57. The sewing object 5 is clamped between the inner frame 55 and the outer frame 56, and is held in a stretched state without wrinkles by the tightening mechanism. Hereinafter, a flat surface that is a virtual plane passing through the inner frame 55 and the outer frame 56 of the embroidery frame 53, and that is parallel to the sewing object 5 clamped by the embroidery frame 53 is referred to as a sewing surface. In a state in which the clamping portion 54 clamps the sewing object 5, and the embroidery frame 53 is attached to the frame holder of the embroidery device 2, the upper surface of the inner frame 55 is visible at a side facing the needle bar 29 of the sewing machine 1.

Frame markers 151 to 154 are disposed, respectively, in positions at the rear left, the rear right, the front right, and the front left of the upper surface of the inner frame 55. Hereinafter, when the frame markers 151 to 154 are collectively referred to, or when there is no distinction to be made between the frame markers 151 to 154, they are referred to as frame markers 150. The frame marker 150 is a circular pattern colored in in black.

The frame markers 150 definitively identify a sewable area 45 defined on the inside of the inner frame 55. The sewable area 45 is an area in which the stitches can be formed by the sewing machine 1. The sewable area 45 has a rectangular shape. Each of sides of the sewable area 45 extend in the left-right direction or the front-rear direction, respectively. A size of the sewable area 45 differs depending on the type of the embroidery frame 53. An intersection point between a straight line extending between the frame markers 151 and 153 and a straight line extending between the frame markers 152 and 154 is aligned with a center of gravity position of the sewable area 45. Hereinafter, this point is referred to as a center point 46A.

A type marker 160 is disposed on the front side of the upper surface of the inner frame 55. The type marker 160 is a marker indicating the type of the embroidery frame 53, and includes at least one square pattern that is colored in in black. A plurality of types of the embroidery frame 53, which differ in at least one of size and shape, can be selectively mounted to the embroidery device 2. A number of the patterns included in the type marker 160 differs depending on the type of the embroidery frame 53.

The mounting portion 58 is coupled to the left end portion of the outer frame 56 of the clamping portion 54, and extends to the left. The embroidery frame 53 is detachably mounted to the embroidery device 2 as a result of the left end portion of the mounting portion 58 being mounted to the frame holder (not shown in the drawings) of the embroidery device 2.

When the stitches are formed using the X-axis conveyance mechanism 87 and the Y-axis conveyance mechanism 88 (refer to FIG. 5) of the embroidery device 2, the embroidery frame 53 is moved in accordance with the coordinate data, which uses a first coordinate system as a reference. The needle bar 29 on which the sewing needle 28 is mounted, and the shuttle mechanism (not shown in the drawings) are driven along with the movement of the embroidery frame 53. The stitches representing the pattern are formed on the sewing object 5 by the above-described processing.

The first coordinate system is an XY coordinate system that is unique to the embroidery device 2, and is the coordinate system of the X-axis motor 82 and the Y-axis motor 83 that move the carriage 52. The X direction of the first coordinate system is aligned with the left-right direction of the sewing machine 1. The direction from the left to the right of the sewing machine 1 is a forward direction in the X direction, and the direction from the right to the left of the sewing machine 1 is a reverse direction in the X direction. The Y direction of the first coordinate system is aligned with the front-rear direction of the sewing machine 1. The direction from the front to the rear of the sewing machine 1 is a forward direction in the Y direction, and the direction from the rear to the front of the sewing machine 1 is a reverse direction in the Y direction. The origin point of the first coordinate system is aligned with the needle drop point.

In a state in which the inner frame 55 and the outer frame 56 of the embroidery frame 53 are in a positional relationship that is defined in advance (hereinafter referred to as a prescribed state), the position of the embroidery frame 53 that has been disposed such that the center point 46A is aligned with the needle drop point is referred to as a reference position. The positional relationship between the inner frame 55 and the outer frame 56 being in the prescribed state is, for example, a positional relationship of a substantially uniform interval across the whole of the inner frame 55 and the outer frame 56 in a state in which the sewing object 5 is not clamped between the inner frame 55 and the outer frame 56. In other words, the prescribed state is a state in which the sewing object 5 is not clamped between the inner frame 55 and the outer frame 56, and the outer frame 56 and the inner frame 55 are assembled together. In the sewing machine 1, driving conditions of the embroidery device 2 in order to dispose the embroidery frame 53 at the reference position in which the positional relationship between the inner frame 55 and the outer frame 56 is the prescribed state are set in advance for each type of the embroidery frame 53.

Embroidery Pattern 200, Pattern Data, Sewing Data

The embroidery pattern, pattern data, and sewing data will be explained, taking an embroidery pattern 200 shown in FIG. 3 as an example. Note that the left-right direction and the front-rear direction on paper in FIG. 3 respectively correspond to the X direction and the Y direction of the first coordinate system.

Figure 3:
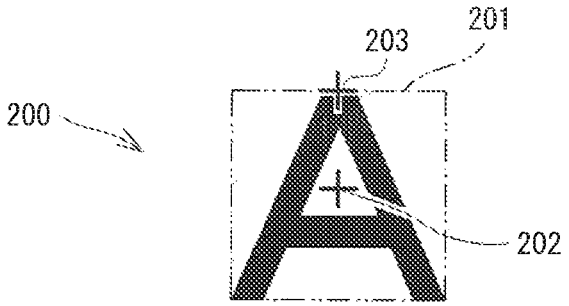
FIG. 3 is an explanatory diagram of an embroidery pattern 200.

The embroidery pattern 200 shown in FIG. 3 is a pattern representing the capital letter "A" of the alphabet. The pattern data is data for forming the stitches representing the embroidery pattern 200. The pattern data includes coordinate data. The coordinate data represents a sewing position and a sewing order. The sewing position is represented by coordinates based on the first coordinate system. All of the coordinate data of the pattern data are defined such that a center point 202 of the embroidery pattern 200 (more specifically, of a minimum rectangle 201 encompassing the embroidery pattern 200) is aligned with the origin point of the first coordinate system.

The sewing data is data for forming the stitches representing the embroidery pattern 200, at a position and/or an angle instructed by the user by a panel operation. The sewing data includes coordinate data. All of the coordinate data of the sewing data are defined such that the center point 202 of the embroidery pattern 200 (more specifically, of the minimum rectangle 201 encompassing the embroidery pattern 200) is aligned with a position instructed by the panel operation. The coordinate data of the sewing data are defined such that an inclination of a line segment joining the center point 202 and a point 203 of the embroidery pattern 200 is aligned with an inclination instructed by the panel operation.

Reference Marker 110

Figure 4:
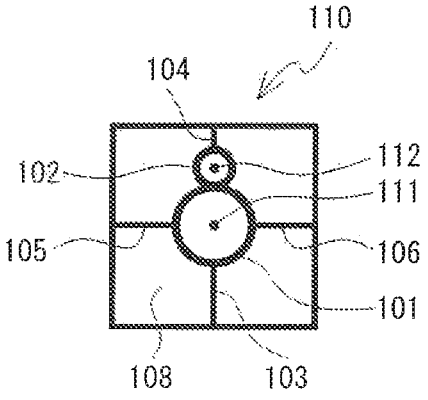
FIG. 4 is an explanatory diagram of a reference marker 110.

A reference marker 110 will be explained with reference to FIG. 4. The reference marker 110 is a marker used by the user to instruct a position on the sewing object 5 held by the embroidery frame 53, and is used when determining a deviation from the prescribed state of the positional relationship between the inner frame 55 and the outer frame 56. The reference marker 110 is attached to a desired position inside the sewable area 45 of the sewing object 5 clamped by the embroidery frame 53.

The reference marker 110 includes a thin white plate-shaped sheet 108, and a line image drawn in black on the upper surface of the sheet 108. The sheet 108 is, for example, a square shape having a length of approximately 2.5 (cm) and a width of approximately 2.5 (cm). The line image drawn on the upper surface of the sheet 108 includes a first circle 101, a first reference point 111 that is the center of the first circle 101, a second circle 102, a second reference point 112 that is the center of the second circle 102, and line segments 103, 104, 105, and 106.

The first circle 101 is drawn such that a center point of the square sheet 108 is the first reference point 111. The second circle 102 is drawn in contact with the first circle 101, and in a position in which a virtual straight line (not shown in the drawings) passing through the first reference point 111 and the second reference point 112 is parallel to one side of the sheet 108. The diameter of the second circle 102 is smaller than the diameter of the first circle 101. The line segments 103 and 104 are line segments that overlap with the virtual straight line (not shown in the drawings) passing through the first reference point 111 and the second reference point 112, and that extend to the outer edge of the sheet 108 from the first circle 101 and the second circle 102, respectively. The line segments 105 and 106 are line segments that overlap with a virtual straight line (not shown in the drawings) passing through the first reference point 111 of the first circle 101 and orthogonal to the line segment 103, and that extend to the outer edge of the sheet 108 from the outer edge of the first circle 101, respectively.

Configuration of Mobile Terminal 3

As shown in FIG. 1, the mobile terminal 3 is a known multifunctional mobile telephone (a so-called smart phone). An operating switch 131, a touch panel 132, and a display portion 135 are provided on the upper surface of the mobile terminal 3, and a camera 136 (refer to FIG. 5) is provided on a lower surface of the mobile terminal 3. The operating switch 131 is used when inputting various commands into the mobile terminal 3. The display portion 135 is a liquid crystal display. An image including various items, such as commands, illustrations, setting values, messages, and the like are displayed on the display portion 135. The touch panel 132 is provided on the front surface side of the display portion 135 and can detect a pressed position. When the user performs an operation to press the touch panel 132 using a finger or a dedicated touch pen, the pressed position is detected by the touch panel 132. Then, on the basis of the detected pressed position, it is recognized which of the items in the image has been selected. The camera 136 is, for example, a known CMOS image sensor.

Electrical Configuration

The electrical configuration of the sewing machine 1 will be explained with reference to FIG. 5. A control portion 60 of the sewing machine 1 is provided with the CPU 61, a ROM 62, a RAM 63, a flash ROM 64, a communication I/F 65, and an input/output interface 66. The CPU 61, the ROM 62, the RAM 63, the flash ROM 64, the communication I/F 65, and the input/output interface 66 are electrically connected to each other via a bus 67. A boot program, a BIOS, and the like are stored in the ROM 62. Programs used for the CPU 61 to execute various processing, a sewable area table (refer to FIG. 7), the pattern data, and the like are stored in the flash ROM 64. The communication I/F 65 is an interface for connecting the sewing machine 1 to the network 9.

The input/output interface 66 is electrically connected to the operating switches 21, the touch panel 26, a detection portion 27, drive circuits 70 to 76, and the notification portion 77. The detection portion 27 detects whether or not the embroidery frame 53 is mounted to the embroidery device 2, and inputs a detection result to the CPU 61 via the input/output interface 66. The drive circuits 70 to 76 respectively drive the presser motor 89, the sewing machine motor 79, the conveyance motor 80, the X-axis motor 82, the Y-axis motor 83, and the display portion 15. The notification portion 77 can notify the notification position using the LED light source 77A.

The electrical configuration of the mobile terminal 3 will be explained. The mobile terminal 3 is provided with a CPU 121, a ROM 122, a RAM 123, a flash ROM 124, a communication I/F 125, and an input/output interface 128. The CPU 121 controls the mobile terminal 3. The CPU 121 is electrically connected to the ROM 122, the RAM 123, the flash ROM 124, the communication I/F 125, and the input/output interface 128 via a bus 127. A boot program, a BIOS, and the like are stored in the ROM 122. Temporary data is stored in the RAM 123. Programs used for the CPU 121 to execute various processing, and a relative position table (refer to FIG. 6) are stored in the flash ROM 124. The communication I/F 125 is an interface for connecting the mobile terminal 3 to the network 9.

The input/output interface 128 is connected to the operating switch 131, the touch panel 132, a microphone 133, a speaker 134, the display portion 135, and the camera 136. The microphone 133 converts ambient sound to audio data, and inputs the audio data to the input/output interface 128. The speaker 134 outputs audio on the basis of the audio data output from the input/output interface 128. The display portion 135 displays an image on the basis of image data. The camera 136 generates image data in which a predetermined imaging range is captured. The generated image data is stored in the flash ROM 124.

Relative Position Table

Figure 6:
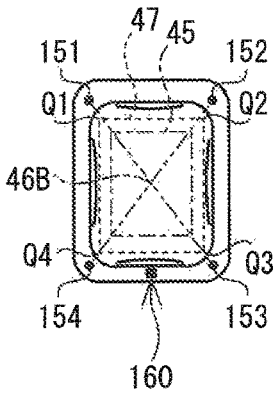
FIG. 6 is a diagram showing a relative position table.
Figure 6:
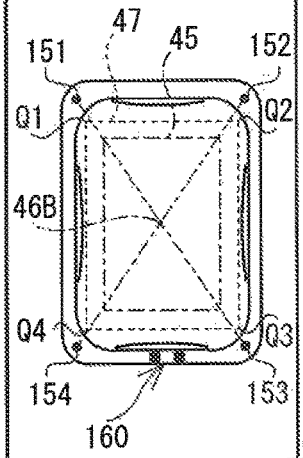
Figure 6:
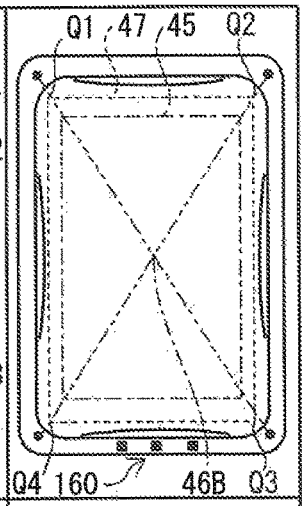

An example of the relative position table stored in the flash ROM 124 of the mobile terminal 3 will be explained with reference to FIG. 6. The relative position table stores an ID indicating the type of the embroidery frame 53, the number of patterns of the type marker 160, relative positions of the frame markers 150, and a relative position of a predetermined surplus area 47, in association with each other. Each of the relative positions of the frame markers 150 and the surplus area 47 is represented by coordinate data based on a second coordinate system, which is unique to the mobile terminal 3.

The relative positions of the frame marker 150 indicate the relative position of each of the frame markers 151 to 154 provided on the inner frame 55. The surplus area 47 is an area that is definitively defined by the frame markers 150. The surplus area 47 is a partial area of the image captured by the camera 136, and is a predetermined area that is somewhat larger than the sewable area 45. The relative position of the surplus area 47 indicates the relative position with respect to the frame marker 150. In FIG. 6, the relative position of the surplus area 47 is represented by coordinate data indicating relative positions of each of points of four corners (points Q1 to A4 of the surplus area 47. The size of the surplus area 47 differs depending on the type of the embroidery frame 53. An intersection point of a straight line extending between the frame markers 151 and 153 and a straight line extending between the frame markers 152 and 154 is aligned with an intersection point of a straight line extending between the points Q1 and Q3 of the surplus area 47 and a straight line extending between points the Q2 and Q4 of the surplus area 47. Hereinafter, this point is referred to as a center point 46B.

The second coordinate system is a coordinate system representing the image when the embroidery frame 53, the sewing object 5, and the reference marker 110 are captured by the camera 136. The X direction of the second coordinate system is aligned with the left-right direction of the embroidery frame 53. The forward direction in the X direction corresponds to the direction from the left to the right of the embroidery frame 53. The reverse direction in the X direction corresponds to the direction from the right to the left of the embroidery frame 53. The forward direction in the Y direction corresponds to the direction from the front to the rear of the embroidery frame 53. The reverse direction in the Y direction corresponds to the direction from the rear to the front of the embroidery frame 53. An origin point of the second coordinate system is aligned with the center point 46B. Unit lengths of each of the X direction and the Y direction of the second coordinate system are set such that the positions of each of the embroidery frame 53, the sewing object 5, and the reference marker 110 included in the image are aligned with the positions, in the first coordinate system, of each of the embroidery frame 53 in the reference position, the sewing object 5, and the reference marker 110, when the positional relationship of the inner frame 55 and the outer frame 56 is the prescribed state.

When the CPU 121 of the mobile terminal 3 has acquired the image captured by the camera 136, the CPU 121 can identify the surplus area 47 in the image on the basis of the relative position table.

Sewable Area Table

Figure 7:
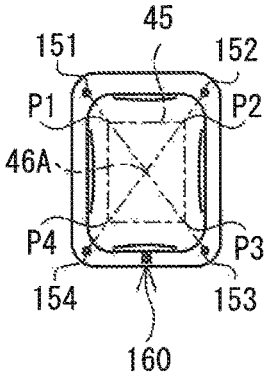
FIG. 7 is a diagram showing a sewable area table.
Figure 7:
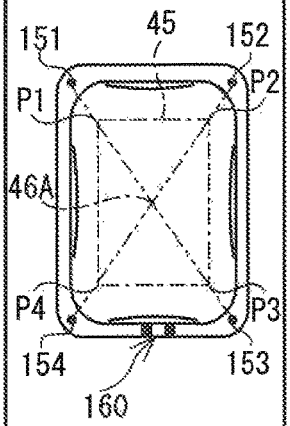
Figure 7:
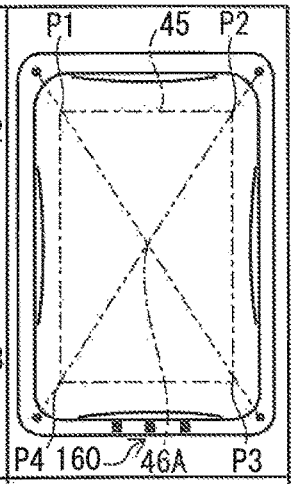

An example of the sewable area table stored in the flash ROM 64 of the sewing machine 1 will be explained with reference to FIG. 7. The sewable area table stores the ID indicating the type of the embroidery frame 53, and the relative position of the sewable area 45 in association with each other. The relative positions of the sewable areas 45 are respectively defined using the center point 46B (refer to FIG. 6) of a surplus image, which is a part of the image transmitted from the mobile terminal 3. The relative position of the sewable area 45 is represented by coordinate data, based on the first coordinate system, of four corners (points P1 to P4) of the sewable area 45. When the CPU 61 of the sewing machine 1 has received the surplus image transmitted from the mobile terminal 3, the CPU 61 can identify the sewable area 45 in the surplus image on the basis of the sewable area table.

Figure 8:
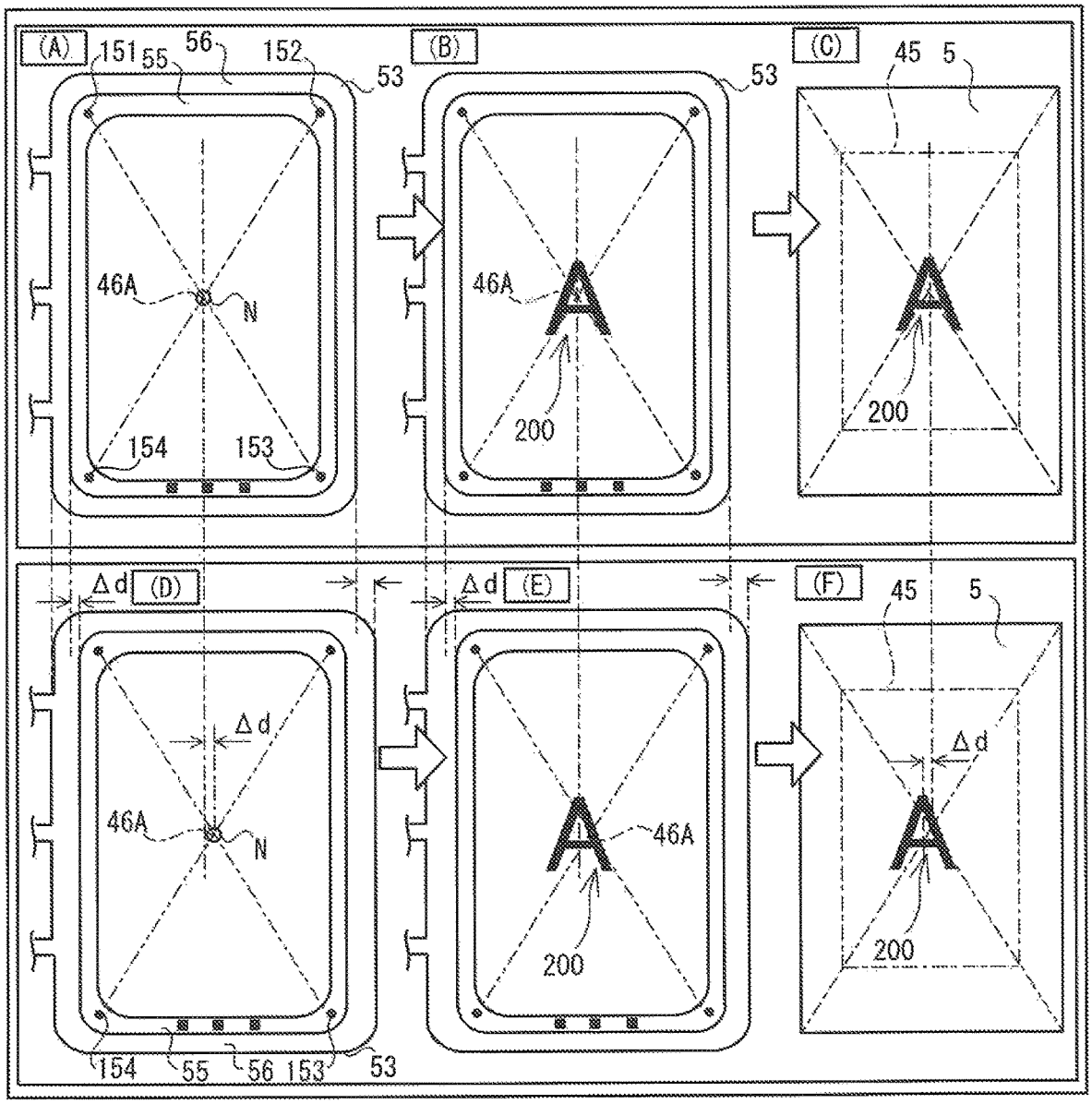
FIG. 8 is a diagram showing a positional relationship between an inner frame 55 and an outer frame 56 of the embroidery frame 53.

Positional relationship between inner frame 55 and outer frame 56 As shown in FIG. 8, the positional relationship between the inner frame 55 and the outer frame 56 may change depending on the thickness and the like of the sewing object 5 clamped by the embroidery frame 53. For example, when the inner frame 55 deviates by Δd in the X direction (the forward direction) in relation to the outer frame 56 with respect to the prescribed state (refer to FIG. 8(A)), even when the embroidery frame 53 is disposed in the reference position, as shown in FIG. 8(D), the center point 46A deviates by Δd with respect to a needle drop point N. This is because, when the position of the center point 46A is determined in accordance with the arrangement of the frame markers 150 of the inner frame 55, the reference position of the embroidery frame 53 is defined as a result of the embroidery device 2 adjusting the position of the outer frame 56 via the mounting portion 58.

Note that the sewing machine 1 sews the embroidery pattern 200 on the sewing object 5 clamped by the clamping portion 54, as a result of the embroidery device 2 moving the clamping portion 54 via the mounting portion 58 of the embroidery frame 53, using the X-axis conveyance mechanism 87 and the Y-axis conveyance mechanism 88. At this time, the sewing machine 1 sews the embroidery pattern 200 by causing the embroidery device 2 to move the embroidery frame 53 assuming that the positional relationship between the inner frame 55 and the outer frame 56 is the prescribed state. Here, as shown in FIG. 8(B), when the positional relationship between the inner frame 55 and the outer frame 56 is the prescribed state, the embroidery pattern 200 is sewn such that the center point 202 (refer to FIG. 3) of the embroidery pattern 200 is aligned with the center point 46A. On the other hand, when the positional relationship between the inner frame 55 and the outer frame 56 deviates with respect to the prescribed state, as shown in FIG. 8(E), the embroidery pattern 200 is sewn such that the center point 202 deviates from the center point 46A. Thus, as shown in FIG. 8(F), the position of the embroidery pattern 200 sewn on the sewing object 5 deviates by Δd in the X direction (the reverse direction) with respect to when the positional relationship between the inner frame 55 and the outer frame 56 is the prescribed state (refer to FIG. 8(C)).

In contrast to this, in the present embodiment, by performing first main processing (refer to FIG. 9) and second main processing (refer to FIG. 11 and FIG. 12) to be described below, the deviation from the prescribed state of the positional relationship between the inner frame 55 and the outer frame 56 is determined by the sewing machine 1. Thus, even when the positional relationship between the inner frame 55 and the outer frame 56 deviates from the prescribed state, the embroidery pattern 200 is sewn on the sewing object 5 at the position desired by the user.

Processing Executed by Mobile Terminal 3 (First Main Processing)

The first main processing executed by the mobile terminal 3 will be explained with reference to FIG. 9. The first main processing is started by the CPU 121 executing a program stored in the flash ROM 124 (refer to FIG. 5), when the user operates the operating switch 131 of the mobile terminal 3 to input a command to start the capturing by the camera 136. Note that, before inputting the command into the mobile terminal 3, the user clamps the sewing object 5 in the embroidery frame 53 in advance.

An operation mode is set in advance in the mobile terminal 3. A first mode and a second mode are the operation modes of the mobile terminal 3. When the mobile terminal 3 operates in the first mode, it is necessary for the user to adhere, in advance, the reference marker 110 at a given position in the sewable area 45 of the sewing object 5 clamped by the embroidery frame 53. On the other hand, when the mobile terminal 3 operates in the second mode, it is not necessary to adhere the reference marker 110 to the sewing object 5. The setting of the operation mode is stored in the flash ROM 124. Note that when the first main processing is started, the operation mode of the mobile terminal 3 may be selected by the user operating the operating switch 131. The CPU 121 may set the operation mode selected by the user.

Figure 9:
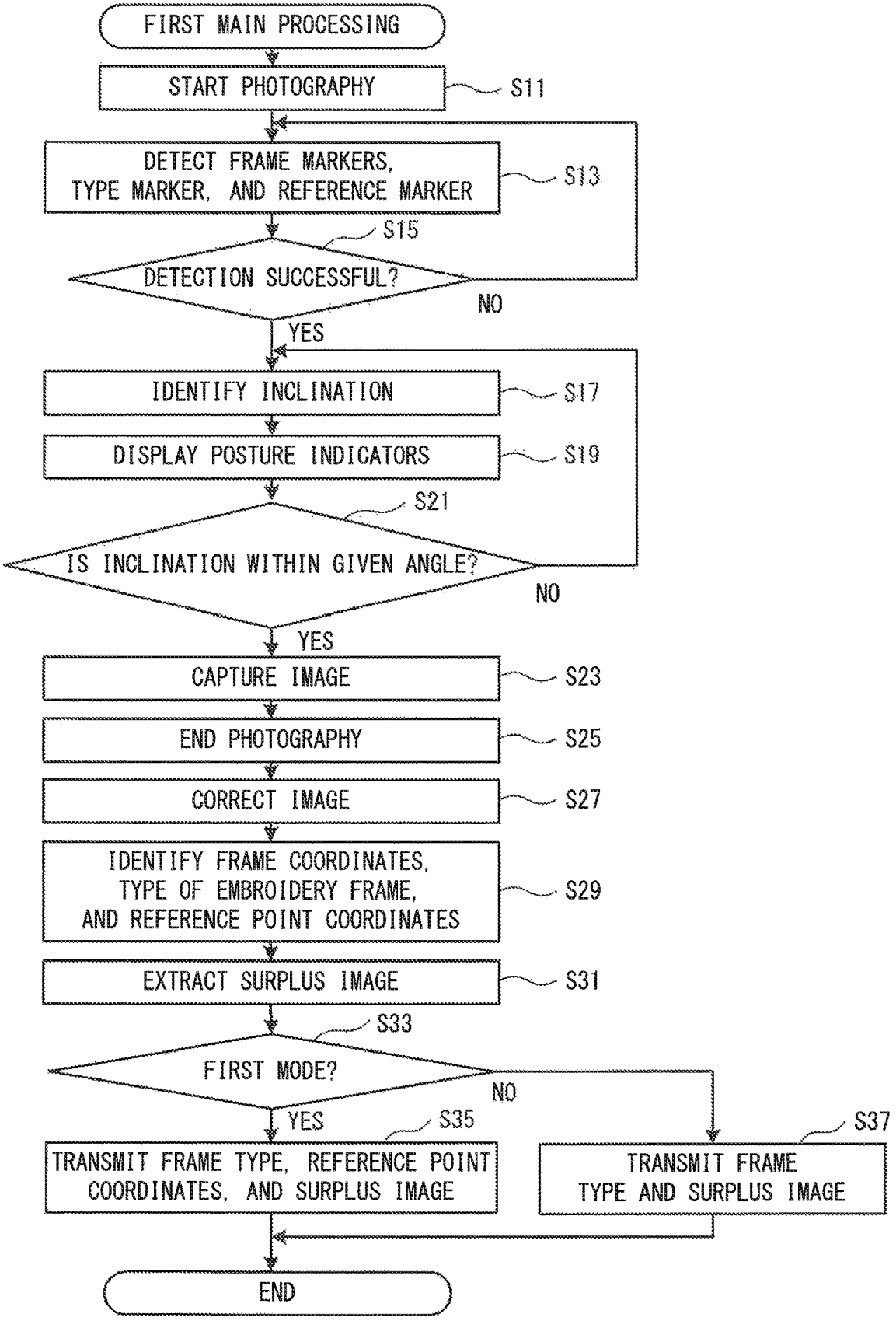
FIG. 9 is a flowchart of first main processing.

As shown in FIG. 9, the CPU 121 starts the capturing by the camera 136 in accordance with an operation of the user on the touch panel 132 (step S11). The camera 136 captures the predetermined imaging range, and acquires the image. The CPU 121 continuously acquires the image output from the camera 136 until the capturing by the camera 136 is ended by processing at step S25. The CPU 121 displays the acquired image on the display portion 135. The user adjusts the position of the mobile terminal 3 such that the four frame markers 150 (refer to FIG. 2) and the type marker 160 (refer to FIG. 2) are displayed on the display portion 135. At this time, when the reference marker 110 (refer to FIG. 4) is adhered to the sewing object 5, the reference marker 110 is also displayed on the display portion 135.

The CPU 121 attempts to detect the four frame markers 150 and the type marker 160 on the basis of the acquired image (step S13). Further, when operating in the first mode, the CPU 121 also attempts to detect the reference marker 110 (step S13). Any known image detection method may be used for the detection of the four frame markers 150, the type marker 160, and the reference marker 110. An edge extraction method is an example of the detection method. Further, the four frame markers 150 (circular) and the type marker 160 (square) may be distinguished on the basis of a shape of a feature point extracted by the edge extraction method. Further, when operating in the first mode, the reference marker 110 may be detected by performing pattern matching using a template indicating contour lines of the first circle 101 and the second circle 102 and the line segments 103 to 106.

The CPU 121 determines whether or not detection has been successful for all of the target markers (the four frame markers 150, the type marker 160, and the reference marker 110 in the case of the first mode, and the four frame markers 150 and the type marker 160 in the case of the second mode) (step S15). When at least one of any of the target markers cannot be detected (no at step S15), the CPU 121 returns the processing to step S13. The CPU 121 repeats the attempt to detect the target markers on the basis of the image (step S13). When all of the target markers have been successfully detected (yes at step S15), the CPU 121 advances the processing to step S17.

On the basis of the positional relationship of the detected four frame markers 150, the CPU 121 identifies an inclination of an optical axis of the camera 136 with respect to the sewing surface of the embroidery frame 53 (step S17). The optical axis of the camera 136 is, specifically, an axis that is orthogonal to an imaging element of the camera 136 and passes through a center of the imaging element. A method of identifying the inclination of the optical axis of the camera 136 with respect to the sewing surface is as described below.

When the sewing surface and the optical axis of the camera 136 are orthogonal to each other, of the four frame markers 150 (refer to FIG. 2) included in the image, a line segment joining the frame markers 151 and 152 and a line segment joining the frame markers 153 and 154 both extend in a predetermined first direction and are parallel to each other. Further, of the four frame markers 150 included in the image, a line segment joining the frame markers 151 and 154 and a line segment joining the frame markers 152 and 153 both extend in a second direction orthogonal to the first direction, and are parallel to each other. Thus, when the above conditions are satisfied, the CPU 121 determines that the sewing surface and the optical axis of the camera 136 are orthogonal to each other.

At this time, the CPU 121 identifies a first direction component of an angle (hereinafter referred to as a first angle) formed by a direction that is orthogonal to the sewing surface (hereinafter referred to as a direction orthogonal to the sewing surface) and the optical axis of the camera 136 as being 0°, and identifies a second direction component of the angle (hereinafter referred to as a second angle) formed by the direction orthogonal to the sewing surface and the optical axis of the camera 136 as being 0°. The first angle and the second angle correspond to the inclination of the optical axis of the camera 136 with respect to the sewing surface.

On the other hand, when, of the four frame markers 150 included in the image, the line segment joining the frame markers 151 and 152 and the line segment joining the frame markers 153 and 154 are not parallel to each other, the CPU 121 determines that the optical axis of the camera 136 is inclined in the first direction with respect to the direction orthogonal to the sewing surface. In this case, the CPU 121 identifies the first angle on the basis of an angle between the line segment joining the frame markers 151 and 152 and the line segment joining the frame markers 153 and 154. The first angle is a positive value when the optical axis of the camera 136 is inclined to one side in the first direction with respect to the direction orthogonal to the sewing surface, and is a negative value when the optical axis of the camera 136 is inclined to the other side in the first direction with respect to the direction orthogonal to the sewing surface. An absolute value of the first angle is larger the greater the inclination angle of the optical axis of the camera 136 in the first direction with respect to the direction orthogonal to the sewing surface.

Further, when, of the four frame markers 150 included in the image, the line segment joining the frame markers 151 and 154 and the line segment joining the frame markers 152 and 153 are not parallel to each other, the CPU 121 determines that the optical axis of the camera 136 is inclined in the second direction with respect to the direction orthogonal to the sewing surface. In this case, the CPU 121 identifies the second angle on the basis of an angle between the line segment joining the frame markers 151 and 154 and the line segment joining the frame markers 152 and 153. The second angle is a positive value when the optical axis of the camera 136 is inclined to one side in the second direction with respect to the direction orthogonal to the sewing surface, and is a negative value when the optical axis of the camera 136 is inclined to the other side in the second direction with respect to the direction orthogonal to the sewing surface. An absolute value of the second angle is larger the greater the inclination angle of the optical axis of the camera 136 in the second direction with respect to the direction orthogonal to the sewing surface.

As shown in FIG. 9, after identifying the inclination of the optical axis of the camera 136 with respect to the sewing surface, the CPU 121 further displays posture indicators 91 and 92 (refer to FIG. 10) on the display portion 135 on which the image is displayed (step S19).

Figure 10:
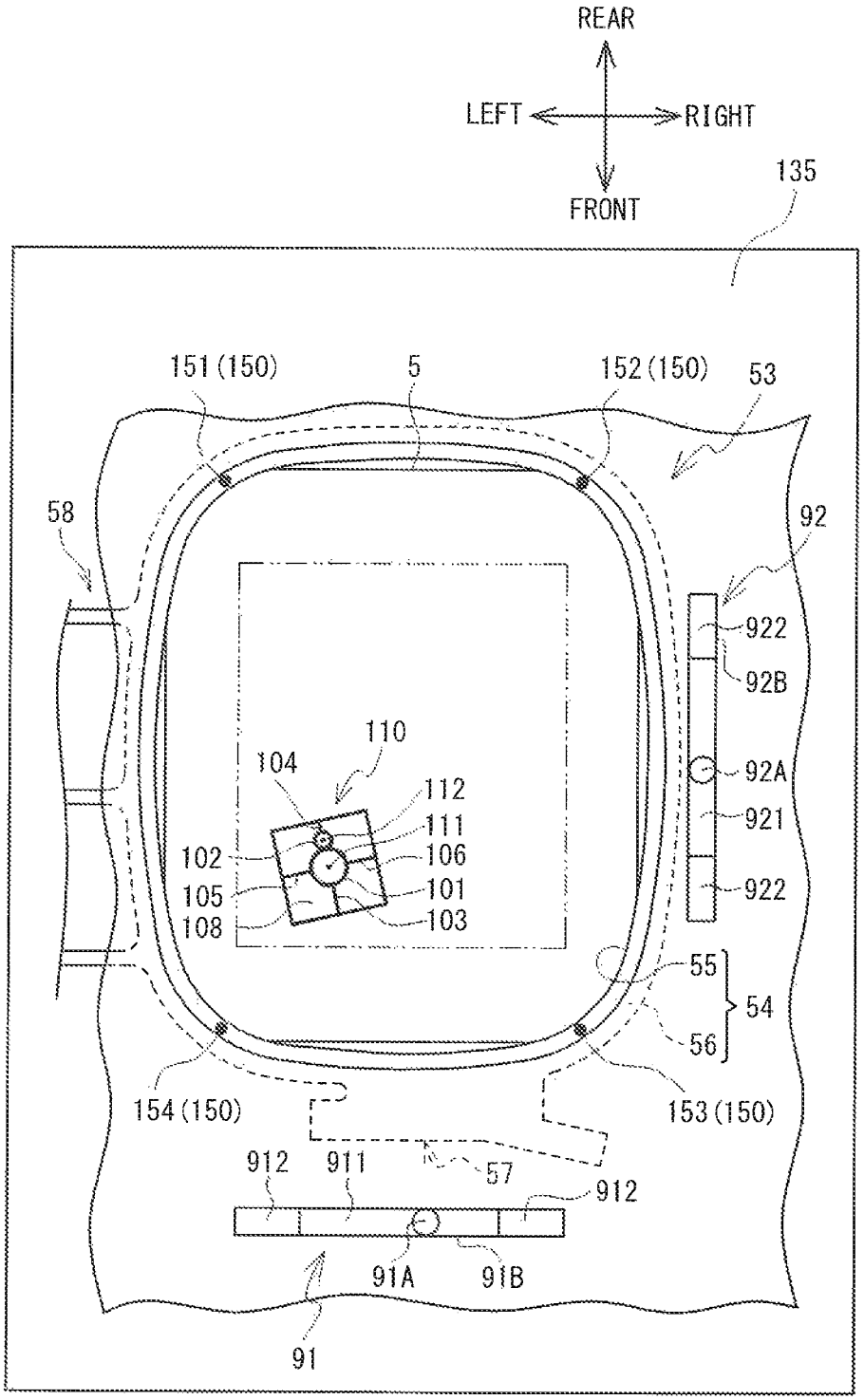
FIG. 10 is a diagram showing posture indicators 91 and 92 displayed on a display portion 135.

The posture indicators 91 and 92 will be explained with reference to FIG. 10. The upper side, the lower side, the left side, and the right side in FIG. 10 respectively correspond to the rear side, the front side, the left side, and the right side of the display portion 135. Here, the rear side, the front side, the left side, and the right side of the embroidery frame 53 included in the image displayed on the display portion 135 are aligned with the rear side, the front side, the left side, and the right side of the display portion 135.

The posture indicator 91 is disposed to the front side with respect to the image of the embroidery frame 53. The posture indicator 91 includes a mark 91A and a movement area 91B. The mark 91A has a circular shape. The movement area 91B has a rectangular shape that is long in the left-right direction, and the mark 91A is disposed inside the movement area 91B. The position, in the left-right direction, of the mark 91A with respect to the movement area 91B indicates the first angle identified by the processing at step S17 (refer to FIG. 9). When the identified first angle is 0°, the mark 91A is disposed in the center, in the left-right direction, of the movement area 91B. The larger the identified first angle becomes in the forward direction, the closer the mark 91A is disposed to the left end portion of the movement area 91B. The larger the identified first angle becomes in the reverse direction, the closer the mark 91A is disposed to the right end portion of the movement area 91B. When the absolute value of the first angle is equal to or lower than a predetermined value, the mark 91A is disposed in a normal area 911 of the movement area 91B, excluding abnormal areas 912 at both the left and right end portions of the movement area 91B. When the absolute value of the first angle is greater than the predetermined value, the mark 91A is disposed in the abnormal area 912.

The posture indicator 92 is disposed to the right side with respect to the image of the embroidery frame 53. The posture indicator 92 incudes a mark 92A and a movement area 92B. The mark 92A has a circular shape. The movement area 92B has a rectangular shape that is long in the front-rear direction, and the mark 92A is disposed inside the movement area 92B. The position, in the front-rear direction, of the mark 92A with respect to the movement area 92B indicates the second angle identified by the processing at step S17 (refer to FIG. 9). When the identified second angle is 0°, the mark 92A is disposed in the center, in the front-rear direction, of the movement area 92B. The larger the identified second angle becomes in the forward direction, the closer the mark 92A is disposed to the front end portion of the movement area 92B. The larger the identified second angle becomes in the reverse direction, the closer the mark 92A is disposed to the rear end portion of the movement area 92B. When the absolute value of the second angle is equal to or lower than a predetermined value, the mark 92A is disposed in a normal area 921 of the movement area 92B, excluding abnormal areas 922 at both the front and rear end portions of the movement area 92B. When the absolute value of the second angle is greater than the predetermined value, the mark 92A is disposed in the abnormal area 922.

As shown in FIG. 9, when the absolute value of at least one of the identified first angle and second angle is greater than the predetermined value, the CPU 121 determines that the inclination of the optical axis of the camera 136 with respect to the sewing surface of the embroidery frame 53 is greater than a given angle (no at step S21). In this case, the CPU 121 returns the processing to step S17, and repeats the processing from step S17 to step S21. Here, the user adjusts an angle of the mobile terminal 3 performing the capturing with respect to the embroidery frame 53, such that the mark 91A is disposed in the normal area 911 of the movement area 91B, and the mark 92A is disposed in the normal area 921 of the movement area 92B. When the absolute value of both the identified first angle and second angle are respectively equal to or less than the predetermined value, the CPU 121 determines that the inclination of the optical axis of the camera 136 with respect to the sewing surface of the embroidery frame 53 is equal to or less than the given angle (yes at step S21). In this case, the CPU 121 advances the processing to step S23.

The CPU 121 captures the image of the camera 136 displayed on the display portion 135, and stores the captured image in the flash ROM 124 as a file (step S23). The CPU 121 ends the capturing by the camera 136 started by the processing at step S1*l* (step S25).

The CPU 121 acquires the image stored in the flash ROM 124 by the processing at step S23. The CPU 121 corrects the image stored in the flash ROM 124, on the basis of the positional relationship of the four frame markers 150 detected by the processing at step S13 in the acquired image (step S27). Specific processing is as follows. For example, there is a possibility that the optical axis of the camera 136 is inclined within a range equal to or less than the given angle with respect to the sewing surface of the embroidery frame 53. In this case, the rectangle having the four frame markers 150 as the respective vertices thereof does not form a square shape, and is distorted. Further, when distortion of the embroidery frame 53 itself has occurred, even if the optical axis of the camera 136 is accurately orthogonal to the sewing surface of the embroidery frame 53, the rectangle having the four frame markers 150 as the respective vertices thereof is distorted. In these cases, the CPU 121 corrects the image stored in the flash ROM 124 such that the rectangle having the four frame markers 150 as the vertices thereof becomes square. Any known correction method may be used for this correction. An example of the correction method includes known distortion correction, such as keystone correction or the like.

The CPU 121 refers to the relative position table (refer to FIG. 6) and identifies the coordinate data representing the positions, based on the second coordinate system, of the four frame markers 150, of the image corrected by the processing at step S27 (step S29). Details of the processing are as follows. The CPU 121 rotates the image such that an extending direction between the frame markers 151 and 152, and between the frame markers 153 and 154 detected by the processing at step S13 is aligned with the X direction, and an extending direction between the frame markers 151 and 154, and between the frame markers 152 and 153 is aligned with the Y direction. Further, the CPU 121 enlarges or reduces the image such that relative positions of the four frame markers 150 detected by the processing at step S13 are aligned with the relative positions stored in the relative position table. The CPU 121 identifies the coordinate data representing the respective positions of the four frame markers 150 when taking the center point 46B (refer to FIG. 6) as the origin point (step S29).

Further, on the basis of the relative position table (refer to FIG. 6), the CPU 121 identifies the type of the embroidery frame 53 corresponding to the number of patterns of the type marker 160 detected by the processing at step S13 (step S29). In addition, when operating in the first mode, the CPU 121 identifies the coordinate data, based on the second coordinate system, of each of the first reference point 111 and the second reference point 112 of the reference marker 110 detected by the processing at step S13 (step S29).

Hereinafter, the coordinate data based on the second coordinate system of each of the four frame markers 150 is referred to as frame coordinate data. The coordinate data based on the second coordinate system of the first reference point 111 of the reference marker 110 is referred to as first reference point coordinate data. The coordinate data based on the second coordinate system of the second reference point 112 of the reference marker 110 is referred to as second reference point coordinate data.

The CPU 121 refers to the relative position table (refer to FIG. 6), and selects the relative position of the surplus area 47 corresponding to the type of the embroidery frame 53 identified by the processing at step S29. The CPU 121 applies the selected relative position of the surplus area 47 with respect to the four frame markers 150 represented by the frame coordinate data identified by the processing at step S29, and identifies the surplus area 47 in the image. Of the image, the CPU 121 cuts out the portion of the identified surplus area 47 and extracts the cut out portion as a surplus image (step S31). Note that the surplus area 47 is the predetermined area that is somewhat larger than the sewable area 45, and is obtained by adding an area to the periphery of the sewable area 45 (refer to FIG. 6). Thus, the surplus image is obtained by further adding an image to the periphery of an image obtained by cutting out the portion of the sewable area 45, of the image.

The CPU 121 identifies whether the operation mode is the first mode (step S33). When it is determined that the operation mode is the first mode (yes at step S33), the CPU 121 advances the processing to step S35. In accordance with an operation by the user on the touch panel 132, the CPU 121 transmits, to the sewing machine 1 via the network 9, first data that includes the type of the embroidery frame 53 identified by the processing at step S29, the first reference point coordinate data and the second reference point coordinate data, and the surplus image extracted by the processing at step S31 (step S35). The CPU 121 ends the first main processing.

On the other hand, when it is determined that the operation mode is the second mode (no at step S33), the CPU 121 advances the processing to step S37. In accordance with an operation by the user on the touch panel 132, the CPU 121 transmits, to the sewing machine 1 via the network 9, second data that includes the type of the embroidery frame 53 identified by the processing at step S29, and the surplus image identified by the processing at step S31 (step S37).

Note that the first reference point coordinate data and the second reference point coordinate data are not included in the second data. The CPU 121 ends the first main processing.

Processing Executed by Sewing Machine 1 (Second Main Processing)

The second main processing executed by the sewing machine 1 will be explained with reference to FIG. 11 and FIG. 12. The second main processing is started by the CPU 61 executing a program stored in the flash ROM 64, when the user performs the panel operation to start the sewing of the embroidery pattern 200 (refer to FIG. 3). Note that, before the panel operation to start the sewing, the user mounts the embroidery frame 53, which is the embroidery frame 53 clamping the sewing object 5 and which has been captured by the camera 136 of the mobile terminal 3, to the embroidery device 2. Here, when the mobile terminal 3 is operating in the first mode, the reference marker 110 is adhered to the sewing object 5.

The CPU 61 enables a state of being able to receive data via the network 9, and stands by to receive data (step S51). When it is determined that the first data or the second data has not been received from the mobile terminal 3 (no at step S53), the CPU 61 returns the processing to step S51. The CPU 61 continues to stand by to receive the data. When it is determined that the first data or the second data has been received (yes at step S53), the CPU 61 advances the processing to step S55. The CPU 61 determines whether the mobile terminal 3 that has received the first data or the second data is operating in the first mode (step S55). When the first data has been received, the CPU 61 determines that the mobile terminal 3 is operating in the first mode (yes at step S55). In this case, the CPU 61 advances the processing to step S57. On the other hand, when the second data has been received, the CPU 61 determines that the mobile terminal 3 is operating in the second mode (no at step S55). In this case, the CPU 61 advances the processing to step S71.

When it is determined that the mobile terminal 3 is operating in the first mode (yes at step S55), the CPU 61 acquires the type of the embroidery frame 53, the first reference point coordinate data and the second reference point coordinate data, and the surplus image included in the first data received by the processing at step S53. The CPU 61 handles the first reference point coordinate data and the second reference point coordinate data as the coordinate data based on the first coordinate system.

Note that a unit length in the second coordinate system that is the basis of the first reference point coordinate data and the second reference point coordinate data is set such that respective positions of the embroidery frame 53, the sewing object 5, and the reference marker 110 included in the image are aligned with the respective positions, in the first coordinate system, of the embroidery frame 53, the sewing object 5, and the reference marker 110 when mounted to the embroidery device 2. Further, when the positional relationship between the inner frame 55 and the outer frame 56 of the embroidery frame 53 is the prescribed state, the origin point of the second coordinate system is aligned with the origin point of the first coordinate system. Thus, when the positional relationship between the inner frame 55 and the outer frame 56 of the embroidery frame 53 is the prescribed state, the first reference point coordinate data and the second reference point coordinate data based on the first coordinate system in place of the second coordinate system represent, respectively, the positions of the actual first reference point 111 and the second reference point 112 of the reference marker 110. On the other hand, when the positional relationship between the inner frame 55 and the outer frame 56 of the embroidery frame 53 is deviated from the prescribed state, the first reference point coordinate data and the second reference point coordinate data based on the first coordinate system in place of the second coordinate system represent, respectively, positions deviated with respect to the actual first reference point 111 and the second reference point 112 of the reference marker 110.

The CPU 61 drives the X-axis movement mechanism 87 and the Y-axis movement mechanism 88 of the embroidery device 2 and moves the embroidery frame 53, such that the first reference point 111 of the reference marker 110 adhered to the sewing object 5 clamped by the embroidery frame 53 approaches the notification position notified by the notification portion 77 (step S57). Note that the notification position notified by the notification portion 77 is aligned with the position of the needle drop point. Further, the position of the needle drop point is aligned with the origin point in the first coordinate system. Thus, on the basis of the acquired first reference point coordinate data, the CPU 61 drives the X-axis movement mechanism 87 and the Y-axis movement mechanism 88 of the embroidery device 2 such that the position represented by the first reference point coordinate data moves to the origin point of the first coordinate system. After that, the CPU 61 illuminates the LED light source 77A of the notification portion 77, irradiates light onto the sewing object 5, and notifies the user of the notification position (step S59).

Figure 13:
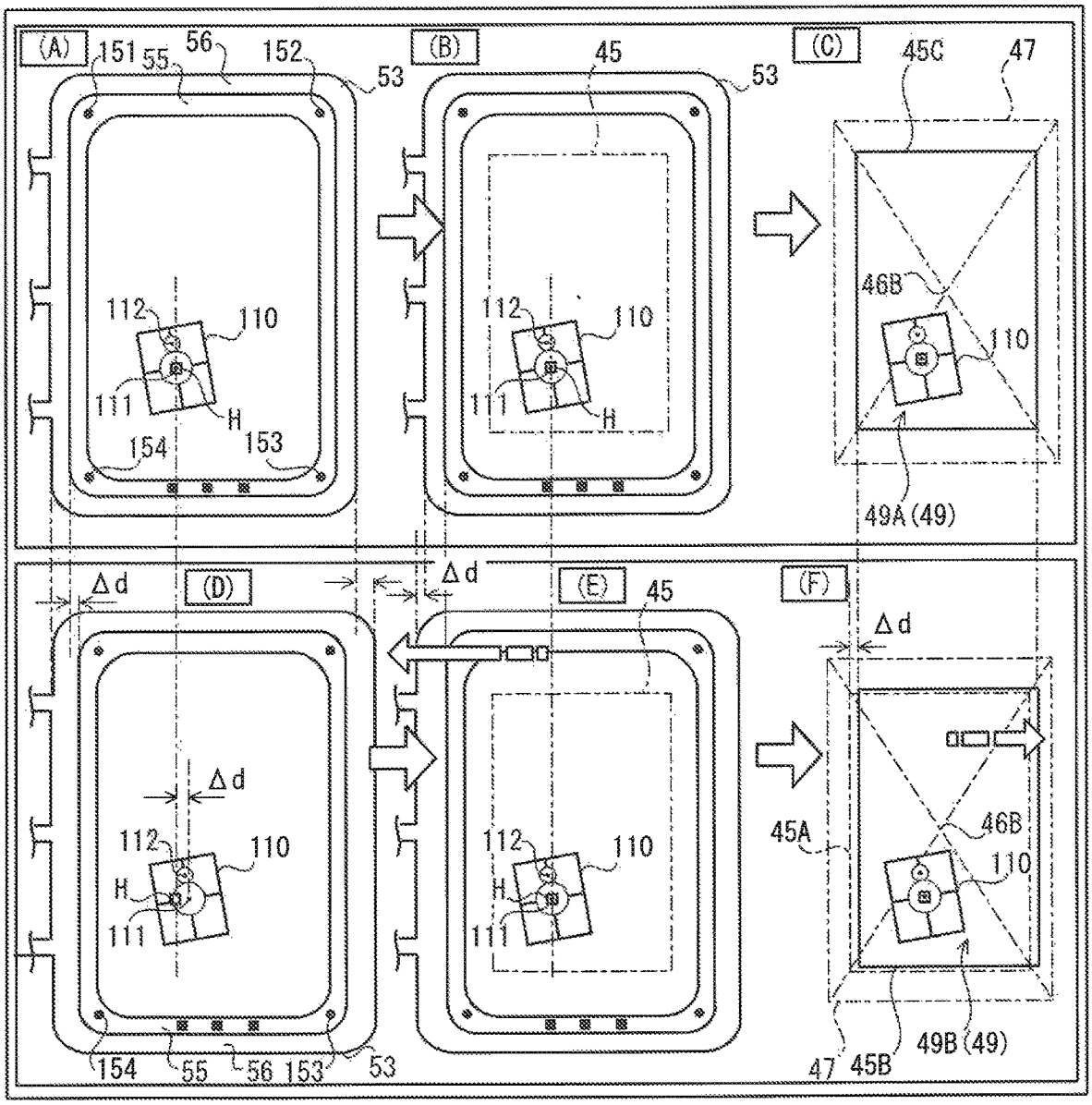
FIG. 13 is diagrams illustrating an operation for aligning a notification position H notified by a notification portion 77 with a reference position.

Here, for example, when the positional relationship between the inner frame 55 and the outer frame 56 of the embroidery frame 53 is the prescribed state, as shown in FIG. 13(A), the position of the first reference point 111 after the embroidery frame 53 has been moved is aligned accurately with a notification position H notified by the notification portion 77. On the other hand, when the positional relationship between the inner frame 55 and the outer frame 56 of the embroidery frame 53 is deviated from the prescribed state, a correspondence relationship between each of the first coordinate system and the second coordinate system is also deviated. Thus, the position represented by the first reference point coordinate data based on the first coordinate system represents a position that is deviated from the first reference point 111 of the actual reference marker 110. As a result, as shown in FIG. 13(D), the position of the first reference point 111 after the embroidery frame 53 has been moved is different from the notification position H notified by the notification portion 77. This difference corresponds to the deviation Δd between the inner frame 55 and the outer frame 56 of the embroidery frame 53.

Figure 11:
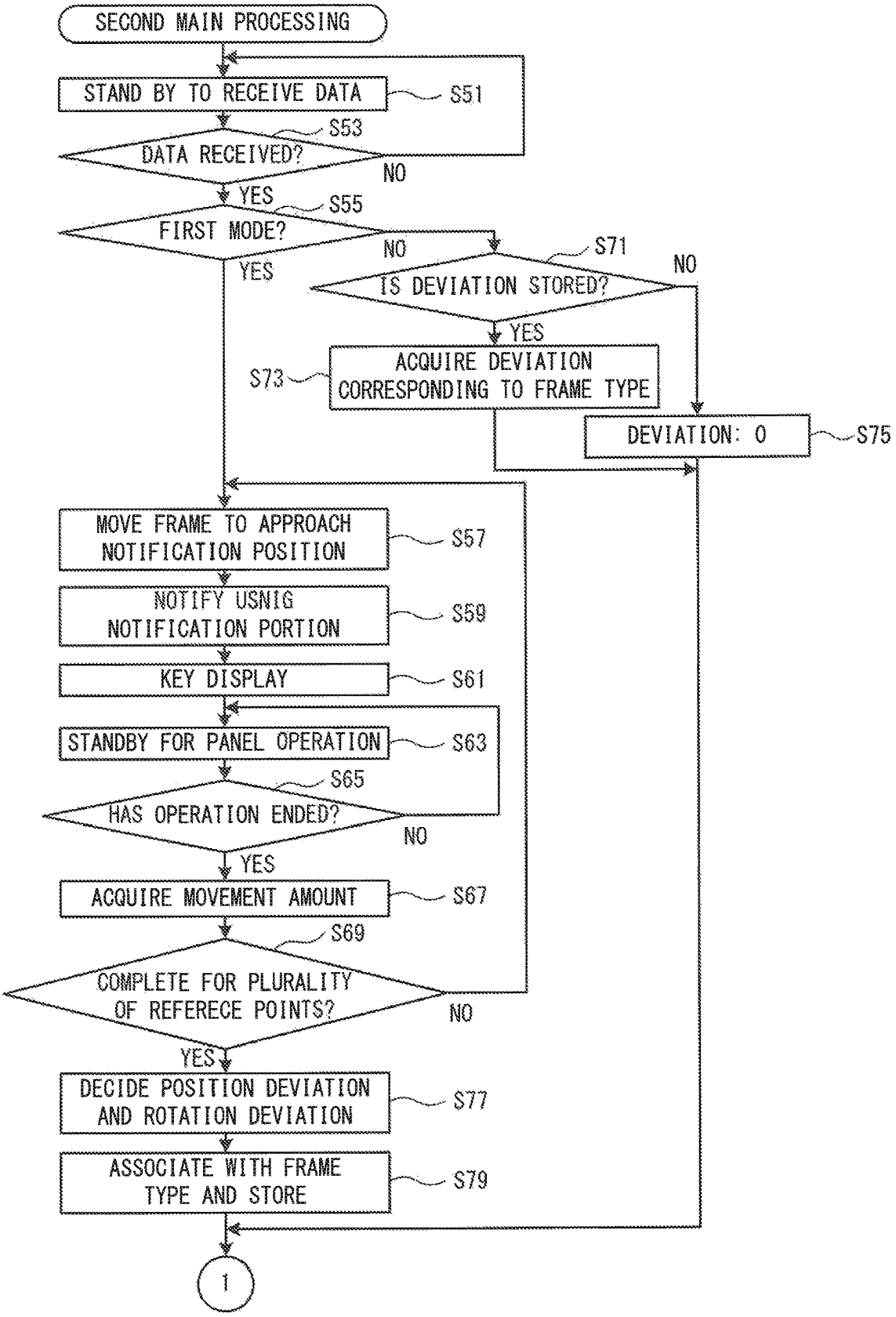
FIG. 11 is a flowchart of second main processing.

As shown in FIG. 11, the CPU 61 displays, on the display portion 15, key images for moving the embroidery frame 53 (step S61). The CPU 61 stands by for the panel operation of the user touching the key images in order to move the embroidery frame 53 (step S63).

The user performs the panel operation for moving the embroidery frame 53 in the left-right direction and the front-rear direction, in order to align the first reference point 111 of the reference marker 110 with the notification position notified by the notification portion 77. The CPU 61 drives the X-axis movement mechanism 87 and the Y-axis movement mechanism 88 of the embroidery device 2 and moves the embroidery frame 53 in accordance with the panel operation. The CPU 61 determines whether the panel operation by the user has ended (step S65). When it is determined that the panel operation has not ended (no at step S65), the CPU 61 returns the processing to step S63, and continues to stand by for the panel operation. When it is determined that the panel operation has ended (yes at step S65), the CPU 61 advances the processing to step S67. The CPU 61 acquires a movement amount (hereinafter referred to as a first movement amount) of the embroidery frame 53 that has been moved by the panel operation (step S67). The CPU 61 advances the processing to step S69.

In the example shown in FIG. 13(D), the first reference point 111 of the reference marker 110 is deviated by Δd in the forward direction in the X direction with respect to the notification position H. Thus, the panel operation is performed by the user to move the embroidery frame 53 in the reverse direction in the X direction by Δd. Thus, as shown in FIG. 13(E), the first reference point 111 of the reference marker 110 is aligned with the notification position H. In this case, the CPU 61 acquires Δd (in the reverse direction in the X direction) as the first movement amount (refer to step S67 in FIG. 11).

As shown in FIG. 11, the CPU 61 determines whether the panel operation to perform the alignment with the notification position notified by the notification portion 77 has been received for each of the first reference point 111 and the second reference point 112 of the reference marker 110 (step S69). When it is determined that the panel operation to align the second reference point 112 of the reference marker 110 with the notification position notified by the notification portion 77 has not been received (no at step S69), the CPU 61 returns the processing to step S57.

The CPU 61 drives the X-axis movement mechanism 87 and the Y-axis movement mechanism 88 of the embroidery device 2 and moves the embroidery frame 53 such that the second reference point 112 of the reference marker 110 adhered to the sewing object 5 clamped by the embroidery frame 53 approaches the notification position notified by the notification portion 77 (step S57). Specifically, on the basis of the second reference point coordinate data acquired from the first data, the CPU 61 drives the X-axis movement mechanism 87 and the Y-axis movement mechanism 88 of the embroidery device 2 such that the position represented by the second reference point coordinate data moves to the origin point of the first coordinate system. After that, the CPU 61 illuminates the LED light source 77A of the notification portion 77, irradiates the light onto the sewing object 5, and notifies the user of the notification position (step S59).

The CPU 61 displays the key images on the display portion 15 (step S61). The CPU 61 stands by for the panel operation (step S63). The user selects the key images and performs the panel operation to move the embroidery frame 53 in the left-right direction and the front-rear direction in order to align the second reference point 112 of the reference marker 110 with the notification position notified by the notification portion 77. The CPU 61 drives the X-axis movement mechanism 87 and the Y-axis movement mechanism 88 of the embroidery device 2 and moves the embroidery frame 53 in accordance with the panel operation. When it is determined that the panel operation by the user has ended (yes at step S65), the CPU 61 acquires the movement amount (hereinafter referred to as a second movement amount) of the embroidery frame 53 that has been moved by the panel operation (step S67). The CPU 61 determines that the panel operation to perform the alignment with the notification position notified by the notification portion 77 has been received for each of the first reference point 111 and the second reference point 112 of the reference marker 110 (yes at step S69), and advances the processing to step S77.

On the basis of the first movement amount and the second movement amount acquired by the processing at step S67, and the first reference point coordinate data and the second reference point coordinate data included in the first data, the CPU 61 decides the deviation from the prescribed state of the positional relationship between the inner frame 55 and the outer frame 56 (step S77). More specifically, as the deviation, the CPU 61 decides the deviation of the position in the X direction and the Y direction based on the first coordinate system (hereinafter referred to as a position deviation) and the deviation in a rotation direction taking the origin point of the first coordinate system as a rotational axis (hereinafter referred to as a rotation deviation) (step S77). Note that the outer frame 56 of the embroidery frame 53 is mounted to the embroidery device 2 via the mounting portion 58, and is directly driven by the X-axis movement mechanism 87 and the Y-axis movement mechanism 88. Thus, the deviation from the prescribed state of the positional relationship between the inner frame 55 and the outer frame 56 corresponds to a deviation in a positional relationship between the inner frame 55 and the X-axis movement mechanism 87 and the Y-axis movement mechanism 88 of the embroidery device 2.

The CPU 61 associates the identified position deviation and rotation deviation with the type of the embroidery frame 53 included in the received first data, and stores the associated information in the flash ROM 64 (step S79). The CPU 61 advances the processing to step S81 (refer to FIG. 12).

Figure 12:
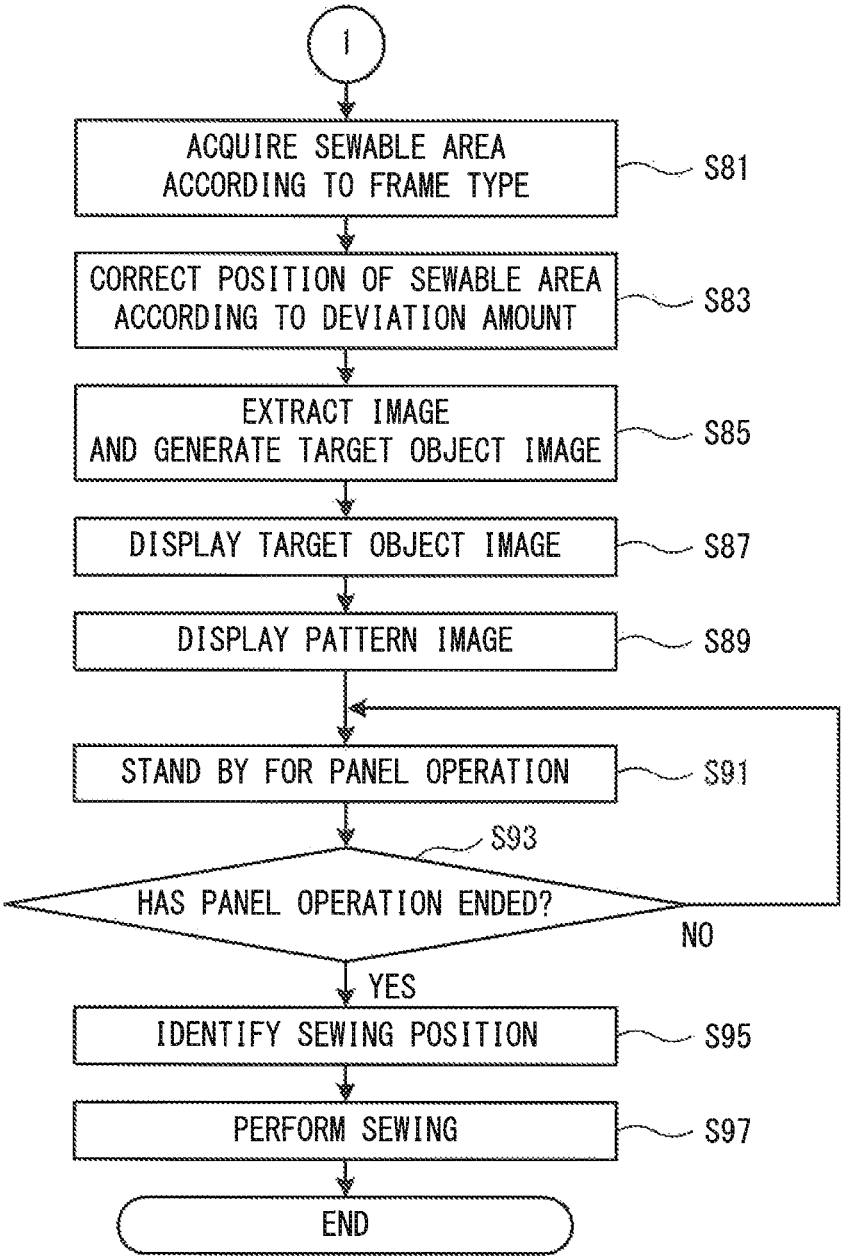
FIG. 12 is a flowchart of the second main processing, and is a continuation of FIG. 11.

As shown in FIG. 12, of the sewable area table (refer to FIG. 7), the CPU 61 acquires the relative position of the sewable area 45 corresponding to the type of the embroidery frame 53 included in the first data (step S81). Note that the relative position of the sewable area 45 of the sewable area table is defined taking the center point 46B (refer to FIG. 6) of the surplus image included in the first data as a reference. Thus, when the positional relationship between the inner frame 55 and the outer frame 56 is deviated with respect to the prescribed state, for example, as shown in FIG. 13(F), an identified sewable area 45A is deviated with respect to a sewable area 45C (refer to FIG. 13(C)) when the positional relationship between the inner frame 55 and the outer frame 56 is the prescribed state.

Thus, as shown in FIG. 12, the CPU 61 performs correction such that the positional deviation and the rotational deviation decided by the processing at step S77 (refer to FIG. 11) are cancelled out, for the coordinate data representing the relative position of the sewable area 45 acquired from the sewable area table (step S83). Of the surplus image, the CPU 61 extracts a portion corresponding to the sewable area 45 corrected by the processing at step S83, and generates a target object image 49 (refer to FIG. 13) (step S85). In the example shown in FIG. 13(F), the correction is performed to move the sewable area 45A by the amount corresponding to Δd in the forward direction in the X direction. Thus, even when the positional relationship between the inner frame 55 and the outer frame 56 is deviated from the prescribed state, an appropriate sewable area 45B depending on the position of the inner frame 55 in the deviated state is identified, and a target object image 49B is extracted.

Figure 14:
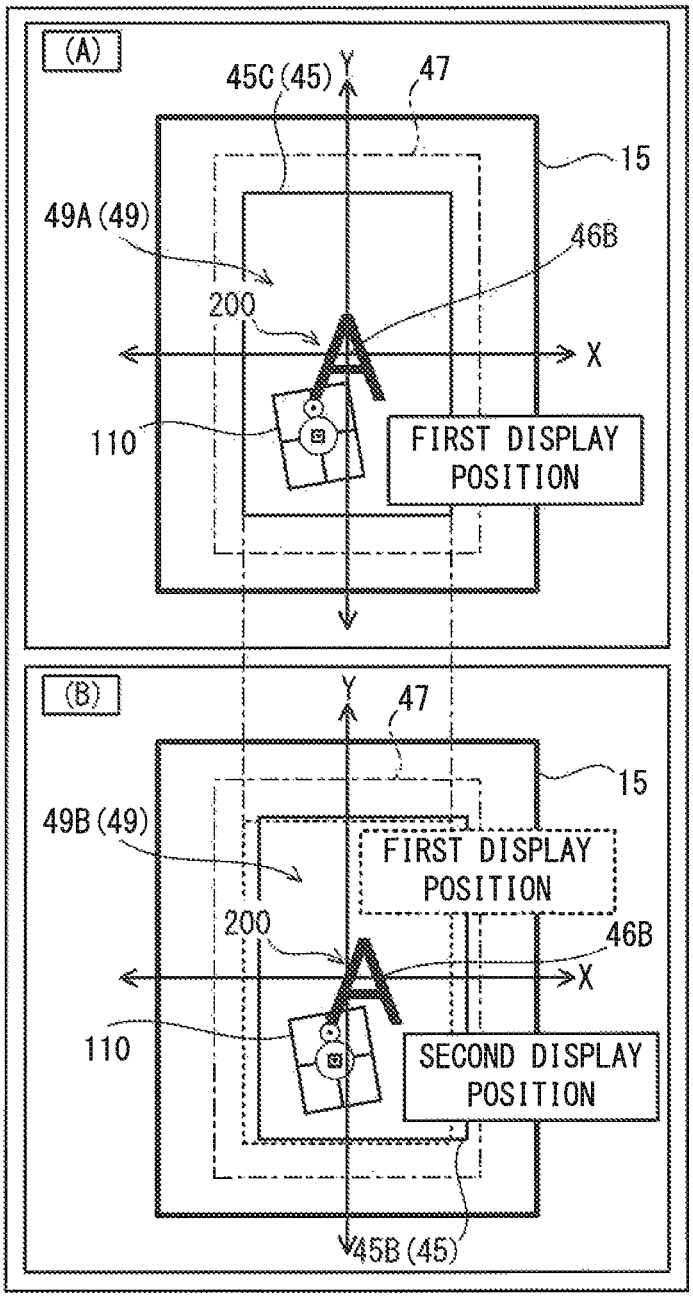
FIG. 14 is diagrams showing a positional relationship between a first display position and a second display position.

As shown in FIG. 12, the CPU 61 displays the generated target object image 49 on the display portion 15 (step S87). FIG. 14 shows a positional relationship between the target object image 49A displayed on the display portion 15 (refer to FIG. 14(A)) when the positional relationship between the inner frame 55 and the outer frame 56 is the prescribed state, and the target object image 49B displayed on the display portion 15 (refer to FIG. 14(B)) when the positional relationship between the inner frame 55 and the outer frame 56 is deviated with respect to the prescribed state. As shown in FIG. 14, the arrangement of the target object image 49 is adjusted such that the center point 46B of the surplus area 47 that is the base of the target object image 49 is aligned with the center of the display portion 15. Further, the orientation of the target object image 49 is adjusted such that the X direction and the Y direction, based on the second coordinate system, of the surplus area 47 that is the base of the target object image 49 are respectively aligned with the left-right direction and the front-rear direction of the display portion 15.

As shown in FIG. 14(A), when the positional relationship between the inner frame 55 and the outer frame 56 is the prescribed state, a display position in which the target object image 49A is arranged with respect to the display portion 15 is a first display position. As shown in FIG. 14(B), when the positional relationship between the inner frame 55 and the outer frame 56 is deviated from the prescribed state, the display position in which the target object image 49B is arranged with respect to the display portion 15 is a second display position. Here, the sewable area 45B for extracting the target object image 49B is corrected by the processing at step S83 (refer to FIG. 12). Thus, the second display position (refer to FIG. 14(B)) in which the target object image 49B is displayed differs from the first display position (refer to FIG. 14(A)) in which the target object image 49A is displayed. In other words, the CPU 61 controls the display position of the respective target object images 49 such that the display position of the target object image 49B (the second display position) when the positional relationship between the inner frame 55 and the outer frame 56 is deviated from the prescribed state differs, with respect to the display position of the target object image 49A (the first display position) when the positional relationship between the inner frame 55 and the outer frame 56 is the prescribed state, by an amount corresponding to the decided deviation.

As shown in FIG. 12, of the embroidery patterns corresponding to each of the plurality of pattern data stored in the flash ROM 64, the CPU 61 receives the panel operation selecting the embroidery pattern 200. The CPU 61 displays, on the display portion 15, a pattern image representing the selected embroidery pattern 200 (refer to FIG. 14) in a superimposed manner on the target object image 49 (step S89). The CPU 61 displays the key images on the display portion 15 and stands by for the panel operation (step S91). In order to specify the sewing position at which the embroidery pattern 200 is to be sewn with respect to the target object image 49, the user selects the key image and performs the panel operation to move the embroidery pattern 200 in the left-right direction and the front-rear direction. The CPU 61 determines whether the panel operation by the user has ended (step S93). When it is determined that the panel operation has not ended (no at step S93), the CPU 61 returns the processing to step S91 and continues to stand by for the panel operation. When it is determined that the panel operation has ended (yes at step S93), the CPU 61 advances the processing to step S95.

The CPU 61 identifies the position of the pattern image set by the panel operation in the following manner (step S95). As shown in FIG. 14, cases are exemplified in which the pattern image is arranged at the center of each of the target object images 49A and 49B. As shown in FIG. 14(A), when the positional relationship between the inner frame 55 and the outer frame 56 is the prescribed state, the CPU 61 identifies, as the sewing position of the embroidery pattern 200 with respect to the sewable area 45 of the sewing object 5, a position based on the first display position of the pattern image with respect to the target object image 49A. On the other hand, as shown in FIG. 14(B), when the positional relationship between the inner frame 55 and the outer frame 56 is deviated from the prescribed state, the CPU 61 does not apply a position based on the second display position of the pattern image with respect to the target object image 49B, and, instead, applies a position based on the first display position of the pattern image with respect to the target object image 49A and identifies the sewing position of the embroidery pattern 200 with respect to the sewable area 45 (refer to FIG. 14(A)) of the sewing object 5. When the sewing position of the embroidery pattern 200 is identified as described above, the deviation of the positional relationship between the inner frame 55 and the outer frame 56 of the embroidery frame 53 is reflected in the sewing position set by panel operation by the user, As shown in FIG. 12, the CPU 61 drives the X-axis movement mechanism 87 and the Y-axis movement mechanism 88 of the embroidery device 2 and moves the embroidery frame 53 such that the embroidery pattern 200 is to be sewn in the identified sewing position, and sews the embroidery pattern 200 on the sewing object 5 (step S97). The CPU 61 ends the second main processing.

On the other hand, as shown in FIG. 11, when it is determined that the mobile terminal 3 is operating in the second mode (no at step S55), the CPU 61 determines whether the deviation associated with the type of the embroidery frame 53 is stored in the flash ROM 64 (step S71). When it is determined that the processing at step S77 has been performed in the past and the deviation associated with the type of the embroidery frame 53 is stored in the flash ROM 64 (yes at step S71), the CPU 61 advances the processing to step S73. The CPU 61 reads out and acquires, from the flash ROM 64, the deviation associated with the type of the embroidery frame 53 included in the second data, as the deviation in the positional relationship of the inner frame 55 and the outer frame 56 from the prescribed state (step S73). In order to perform the sewing of the embroidery pattern 200 using the acquired deviation, the CPU 61 advances the processing to step S81 (refer to FIG. 12).

When it is determined that the processing at step S77 has not been performed and the deviation associated with the type of the embroidery frame 53 is not stored in the flash ROM 64 (no at step S71), the CPU 61 advances the processing to step S75. The CPU 61 sets "0" as the deviation (step S75). In order to sew the embroidery pattern 200 using the set deviation, the CPU 61 advances the processing to step S81 (refer to FIG. 12).

Actions and Effects of Present Embodiment

The sewing machine 1 acquires the movement amount of the embroidery frame 53 necessary to perform the alignment of each of the notification position notified by the notification portion 77, and the first reference point 111 and the second reference point 112 of the reference marker 110 adhered to the sewing object 5 (step S67). On the basis of the acquired movement amount, the sewing machine 1 can decide the deviation in the positional relationship between the inner frame 55 and the outer frame 56 of the embroidery frame 53. Note that the deviation in the positional relationship between the inner frame 55 and the outer frame 56 can also be said to be the deviation in the positional relationship between the inner frame 55 of the embroidery frame 53 and the X-axis movement mechanism 87 and the Y-axis movement mechanism 88 of the embroidery device 2 holding the outer frame 56 of the embroidery frame 53. Thus, even when the position of the sewing object 5 with respect to the outer frame 56 of the embroidery frame 53 is deviated due to the thickness of the sewing object 5 or the like, the sewing machine 1 can drive the embroidery device 2 under driving conditions appropriate for the decided deviation. As a result, the sewing machine 1 can sew the embroidery pattern 200 at the appropriate position on the sewing object 5.

The sewing machine 1 causes the second display position at which the target object image 49B is displayed when the positional relationship between the inner frame 55 and the outer frame 56 is deviated from the prescribed state to differ, by an amount corresponding to the deviation, with respect to the first display position at which the target object image 49A is displayed when the positional relationship between the inner frame 55 and the outer frame 56 is the prescribed state. In this case, the deviation in the positional relationship between the inner frame 55 and the outer frame 56 of the embroidery frame 53 is reflected in the sewing position of the embroidery pattern 200 specified by the user based on the target object image 49. In this case, the sewing machine 1 can sew the embroidery pattern 200 at the position depending on the deviation, without performing processing to convert the coordinate data included in the pattern data of the embroidery pattern 200 in accordance with the deviation.

The sewing machine 1 can acquire the movement amount of the embroidery frame 53 in accordance with receiving the panel operation that moves the embroidery frame 53 in order to align the first reference point 111 and the second reference point 112 with the notification position notified by the notification portion 77. Thus, the sewing machine 1 can easily acquire the movement amount in accordance with the panel operation by the user.

The sewing machine 1 moves the embroidery frame 53 such that each of the first reference point 111 and the second reference point 112 of the reference marker 110 approaches the notification position notified by the notification portion 77 (step S57). After that, the sewing machine 1 acquires the movement amount of the embroidery frame 53 that has moved in accordance with the panel operation by the user (step S67). In other words, the user performs the panel operation to move the embroidery frame 53 by the deviation amount between the inner frame 55 and the outer frame 56 of the embroidery frame 53 only. Thus, the sewing machine 1 can simplify the panel operation for moving the embroidery frame 53.

The notification portion 77 of the sewing machine 1 irradiates the light onto the notification position. When the sewing machine 1 includes the LED light source 77A, the sewing machine 1 can simplify recognition by the user of the notification position.

The sewing machine 1 extracts, as the target object image 49, the portion corresponding to the sewable area 45 of the surplus image included in the first data, and displays the target object image 49 on the display portion 15 (step S87). Furthermore, the sewing machine 1 displays, on the display portion 15, the pattern image representing the embroidery pattern 200 in a superimposed manner on the target object image 49 (step S89). In this case, the user can easily ascertain, by visually verifying the display portion 15, the format in which the embroidery pattern 200 is to be sewn on the sewing object 5.

The sewing machine 1 can decide not only the positional deviation but also the rotational deviation, by acquiring the movement amount of the embroidery frame 53 in order to align each of the first reference point 111 and the second reference point 112 with the notification position notified by the notification portion 77. In this case, the sewing machine 1 can decide the deviation even when the positional relationship between the inner frame 55 and the outer frame 56 of the embroidery frame 53 is deviated in a rotational direction.

The mobile terminal 3 further displays the posture indicators 91 and 92 that indicate the inclination of the optical axis of the camera 136 with respect to the sewing surface, on the display portion 135 on which the image is displayed (step S19). When the inclination of the optical axis of the camera 136 with respect to the sewing surface of the embroidery frame 53 is equal to or less than the given angle, the mobile terminal 3 captures and stores the image of the camera 136 (step S23). In this case, the mobile terminal 3 can identify the first reference point coordinate data and the second reference point coordinate data from the image when the inclination of the optical axis of the camera 136 with respect to the sewing surface of the embroidery frame 53 is equal to or less than the given angle. Thus, the mobile terminal 3 can reliably extract the first reference point 111 and the second reference point 112 and can accurately identify the coordinate data.

When the mobile terminal 3 is operating in the second mode (no at step S55), the sewing machine 1 acquires the deviation stored in the flash ROM 64 as the deviation from the prescribed state of the positional relationship between the inner frame 55 and the outer frame 56 (step S73). In this case, even when the reference point coordinate data cannot be identified in the mobile terminal 3, the sewing machine 1 can decide the deviation of the positional relationship between the inner frame 55 and the outer frame 56 of the embroidery frame 53.

MODIFIED EXAMPLES

Figure 15:
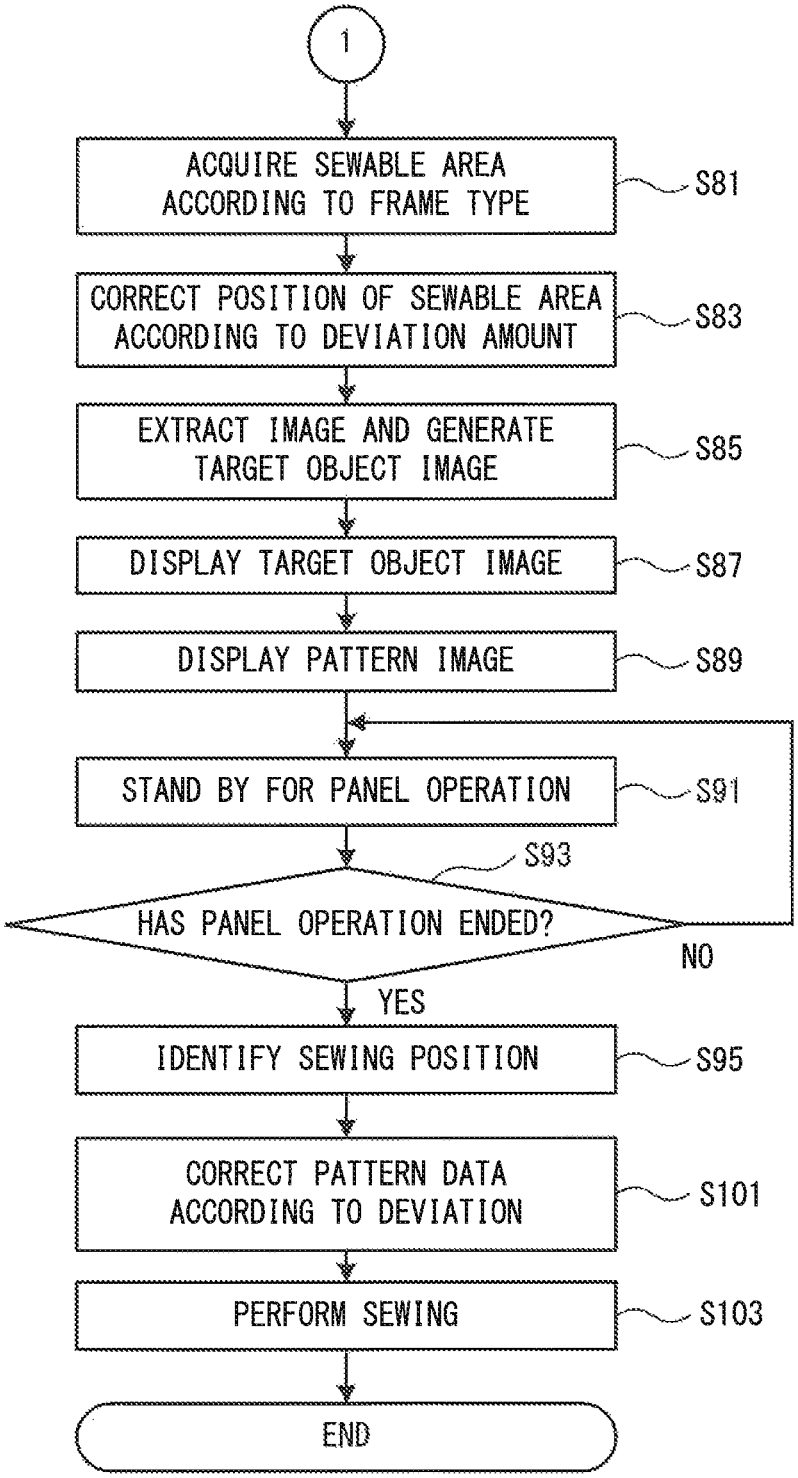
FIG. 15 is a flowchart of the second main processing according to a modified example, and is a continuation of FIG. 11.

A modified example of the second main processing of the present embodiment will be explained with reference to FIG. 11 and FIG. 15. The modified example differs from the above-described embodiment in that the content of the processing at step S87 shown in FIG. 12 differs, and steps S101 and S103 shown in FIG. 15 are performed in place of the processing at step S97. The processing at step S51 to step S79 shown in FIG. 11, and the processing at step S81 to step S95 shown in FIG. 12, excepting step S87, is the same as the above-described embodiment. Hereinafter the processing that differs from the above-described embodiment will be explained in detail, and an explanation of processing that is the same will be simplified.

As shown in FIG. 11, the CPU 61 of the sewing machine 1 associates the identified positional deviation and rotational deviation with the type of the embroidery frame 53 included in the received first data, and stores the associated information in the flash ROM 64 (step S79). After that, the CPU 61 advances the processing to step S81 (refer to FIG. 15). As shown in FIG. 15, the CPU 61 acquires the relative position of the sewable area 45 from the sewable area table (step S81), and performs the correction such that the deviation (the positional deviation and the rotational deviation) of the positional relationship between the inner frame 55 and the outer frame 56 of the embroidery frame 53 is cancelled out (step S83). Of the surplus image, the CPU 61 extracts the portion corresponding to the sewable area 45 corrected by the processing at step S83, and generates the target object image 49 (step S85). The CPU 61 displays the generated target object image 49 on the display portion 15 (step S87). Here, in contrast to the above-described embodiment, the CPU 61 displays the target object image 49 at a prescribed position on the display portion 15, regardless of whether or not the deviation is present in the positional relationship between the inner frame 55 and the outer frame 56 of the embroidery frame 53. In other words, the display position (the first display position) of the target object image 49 when the positional relationship between the inner frame 55 and the outer frame 56 is the prescribed state and the display position (the second display position) of the target object image 49 when the positional relationship between the inner frame 55 and the outer frame 56 is deviated from the prescribed state are the same.

The CPU 61 receives the panel operation selecting the embroidery pattern 200 and displays the selected embroidery pattern 200 on the display portion 15 in the superimposed manner on the target object image 49 (step S89). When it is determined that the panel operation performed by the user to set the position of the pattern image has ended (yes at step S93), the CPU 61 identifies the position of the pattern image with respect to the sewing object 5, based on the first coordinate system (step S95). The CPU 61 reads out and acquires, from the flash ROM 64, the positional deviation and the rotational deviation stored by the processing at step S79. On the basis of the position of the pattern image set by the panel operation and the read out positional deviation and rotational deviation, the CPU 61 corrects the coordinate data included in the pattern data such that the sewing position of the embroidery pattern 200 is changed, and generates the sewing data (step S101). The CPU 61 drives the X-axis movement mechanism 87 and the Y-axis movement mechanism 88 of the embroidery device 2 and moves the embroidery frame 53 on the basis of the generated sewing data, and sews the embroidery pattern 200 on the sewing object 5 (step S103). The CPU 61 ends the second main processing.

As described above, the sewing machine 1 of the modified example decides the deviation of the positional relationship between the inner frame 55 and the outer frame 56 of the embroidery frame 53, and directly corrects the pattern data in accordance with the decided deviation. In this case, the sewing machine 1 can sew the embroidery pattern 200 at the appropriate position on the sewing object 5, by driving the embroidery device 2 on the basis of the sewing data generated by the correction.

Other Modified Examples

The present disclosure is not limited to the above-described embodiment and modified example, and various modifications are possible. The configurations of each of the reference marker 110, the four frame markers 150, and the type marker 160 (the size of the marker, the material, the design, the color, and the like) may be changed as appropriate. In the above explanation, the first reference point 111 and the second reference point 112 that are necessary for deciding the deviation in the positional relationship between the inner frame 55 and the outer frame 56 of the embroidery frame 53 are provided by adhering the reference marker 110 to the sewing object 5. The first reference point 111 and the second reference point 112 may be provided using a different method in a range prescribed by the inner frame 55 of the embroidery frame 53, that is, in a range including the inner frame 55 and a range surrounded by the inner frame 55. For example, the first reference point 111 and the second reference point 112 may be markers (the frame markers 150, for example) provided on the inner frame 55.

The mobile terminal 3 may transmit, to the sewing machine 1, the first data and the second data that do not include the type of the embroidery frame 53. The detection portion 27 of the sewing machine 1 may detect the type of the embroidery frame 53 mounted to the embroidery device 2, and may output a detection result. The CPU 61 of the sewing machine 1 may identify the type of the embroidery frame 53 on the basis of the output result of the detection portion 27.

The user moves the embroidery frame 53 using the panel operation in order to align the positions of the first reference point 111 and the second reference point 112 of the reference marker 110 with the notification position notified by the notification portion 77. The notification portion 77 may be movably provided in the sewing machine 1. The user may move the notification portion 77, using the panel operation, in order to align the positions of the first reference point 111 and the second reference point 112 of the reference marker 110 with the notification position notified by the notification portion 77. Furthermore, the user may align the positions of the first reference point 111 and the second reference point 112 of the reference marker 110 with the notification position notified by the notification portion 77 by moving both the embroidery frame 53 and the notification portion 77 using the panel operation. In these cases also, it is sufficient that a relative movement amount of the notification portion 77 with respect to the embroidery frame 53 is acquired.

The target object images 49A and 49B may be displayed in the same position on the display portion 15. In other words, the first display position at which the target object image 49A is displayed and the second display position at which the target object image 49B is displayed may indicate the same position. In this case, it is sufficient that a range for extracting the target object image 49B from the surplus image is changed by an amount corresponding to the deviation, such that the target object images 49A and 49B are displayed in the same position on the display portion 15.

The user may directly move the embroidery frame 53 by hand in order to align the first reference point 111 and the second reference point 112 of the reference marker 110 with the notification position notified by the notification portion 77. In this case also, the CPU 61 may acquire the movement amount of the embroidery frame 53. Further, the sewing machine 1 may display, on the display portion 15, an image representing the positional relationship between the first reference point 111 and the second reference point 112 of the reference marker 110, and the notification position notified by the notification portion 77. The user may perform the panel operation for aligning, on the display portion 15, the first reference point 111 and the second reference point 112 with the notification position notified by the notification portion 77.

At the start of the second main processing, the sewing machine 1 may arrange the embroidery frame 53 in a reference position. The user may perform the panel operation to move the embroidery frame 53 from the reference position in order to align the first reference point 111 and the second reference point 112 of the reference marker 110 with the notification position notified by the notification portion 77. The sewing machine 1 may decide the deviation from the prescribed state of the positional relationship between the inner frame 55 and the outer frame 56 of the embroidery frame 53 on the basis of the positions of the first reference point 111 and the second reference point 112 represented by each of the first reference point coordinate data and the second reference point coordinate data included in the first data, and on the movement amount of the embroidery frame 53 from the reference position acquired in accordance with the panel operation.

A notification method of the notification position in the sewing machine 1 is not limited to the irradiation of the light by the LED light source 77A of the notification portion 77. For example, the user may recognize, as the notification position, a position on the sewing object 5 on the bed 11 that is directly below the sewing needle 28, that is, the position of the needle drop point, and may perform the panel operation to align the first reference point 111 and the second reference point 112 with that position.

The sewing machine 1 may display all of the surplus image included in the first data on the display portion 15, and may display a rectangular image representing the sewable area 45 in a superimposed manner on the surplus image. In other words, the extraction processing by the sewing machine 1 to extract the target object image from the surplus image need not necessarily be performed.

The first reference point 111 only may be included in the reference marker 110, and the second reference point 112 need not necessarily be included. In this case, the sewing machine 1 may decide only the positional deviation between the inner frame 55 and the outer frame 56 on the basis of the movement amount of the embroidery frame 53 in order to align the first reference point 111 with the notification position notified by the notification portion 77. Further, a plurality of the reference markers 110 each including only the first reference point 111 may be adhered to the sewing object 5. In this case, the positional deviation and the rotational deviation between the inner frame 55 and the outer frame 56 may be decided on the basis of the first reference points 111 of each of the reference markers 110.

The mobile terminal 3 may be provided with an acceleration sensor. The mobile terminal 3 may identify the inclination of the optical axis of the camera 136 with respect to the sewing surface of the embroidery frame 53 that is arranged horizontally, using the acceleration sensor. The mobile terminal 3 may capture the image of the camera 136 when it is determined, using the acceleration sensor, that the inclination of the optical axis of the camera 136 with respect the sewing surface of the embroidery frame 53 is equal to or less than the given angle.

The mobile terminal 3 may transmit, to the sewing machine 1, the first data or the second data that includes flag information indicating the operating mode. When the sewing machine 1 has received the first data or the second data, the sewing machine 1 may determine whether the data is the first data or the second data on the basis of the flag information. In this case, the first reference point coordinate data and the second reference point coordinate data may be included in the second data.

A part or all of the first main processing may be performed by the CPU 61 of the sewing machine 1. In this case, the sewing machine 1 may be provided with a camera, for example, and may identify the coordinate data of the first reference point 111 and the second reference point 112 from the reference marker 110 adhered to the sewing object 5 by capturing the embroidery frame 53 mounted to the embroidery device 2. Further, for example, the mobile terminal 3 may transmit, to the sewing machine 1, the image captured by the camera 136 as it is. The sewing machine 1 may identify the first reference point coordinate data and the second reference point coordinate data on the basis of the image received from the mobile terminal 3. Furthermore, the sewing machine 1 may correct the image on the basis of the coordinate data of the frame markers 150.

The mobile terminal 3 may include coordinate data representing the position of the center point 46B of the surplus image in the first data or the second data, and transmit the first data or the second data to the sewing machine 1. The sewing machine 1 may identify the sewable area 45 on the basis of the coordinate data representing the position of the center point 46B included in the first data or the second data. The mobile terminal 3 may extract the surplus image from the original image without enlarging or reducing the image on the basis of the relative position table, and transmit the surplus image to the sewing machine 1. At this time, the mobile terminal 3 may include resolution information of the surplus image in the first data or the second data, and transmit the first data or the second data to the sewing machine 1. The sewing machine 1 may enlarge or reduce the surplus image, on the basis of the resolution information included in the first data or the second data, such that an image size is obtained corresponding to the type of the embroidery frame 53.

As the mobile terminal 3 in the sewing system 100, a digital camera, a tablet terminal, or the like may be used in place of the smartphone.

The sewing machine 1 acquires the movement amount of the embroidery frame 53 necessary to align the first reference point 111 and the second reference point 112 of the reference marker 110 adhered to the sewing object 5 with the notification position notified by the notification portion 77, on the basis of the panel operation by the user (step S67). In contrast to this, the sewing machine 1 may, for example, capturing the first reference point 111 and the second reference point 112 using a camera or the like, and identify the position thereof, and may calculate and acquire the movement amount of the embroidery frame 53 necessary to perform the alignment of the first reference point 111 and the second reference point 112 with the notification position, in accordance with a relationship between the identified position and the notification position notified by the notification portion 77.

What is claimed is:

1. A sewing system comprising:

a device including an image sensor; and a sewing machine including a movement mechanism configured to hold and move an outer frame of an embroidery frame in a state in which a sewing object is clamped between the outer frame and an inner frame of the embroidery frame, the sewing machine being configured to sew an embroidery pattern on the sewing object, the device including a processor and a memory storing computer-readable instructions that, when executed by the processor, cause the processor to perform processes comprising:

identifying, on the basis of an image when the embroidery frame is captured by the image sensor, reference point coordinates representing a position of a reference point provided in a range prescribed by the inner frame; and transmitting, to the sewing machine, first data including the identified reference point coordinates, and the sewing machine including a processor and a memory storing computer-readable instructions that, when executed by the processor, cause the processor to perform processes comprising:

receiving the first data transmitted by the device;

notifying a notification position, using a notification portion, with respect to the range prescribed by the inner frame of the embroidery frame held by the movement mechanism;

acquiring a relative movement amount of the embroidery frame with respect to the notification portion, for aligning the notified notification position and the position of the reference point provided in the range prescribed by the inner frame of the embroidery frame in the state of being held by the movement mechanism; and deciding, on the basis of a relationship between the acquired movement amount and the reference point coordinates included in the first data received from the device, a deviation from a prescribed state of a positional relationship between the inner frame of the embroidery frame and the movement mechanism holding the outer frame.

2. The sewing system according to claim 1, wherein the computer-readable instructions stored in the memory of the sewing machine further cause the processor of the sewing machine to perform a process comprising:

correcting a sewing position of the embroidery pattern in accordance with the decided deviation.

3. The sewing system according to claim 1, wherein the sewing machine further includes a sewing machine display portion configured to display a target object image, the target object image being an image representing the sewing object, and the computer-readable instructions stored in the memory of the sewing machine further cause the processor of the sewing machine to perform processes comprising:

when the deviation is decided, setting a display position of the target object image, with respect to the sewing machine display portion, at a second display position according with the deviation, from a first display position corresponding to a position of the target object using the prescribed state as a reference; and identifying a sewing position of the embroidery pattern using the position of the sewing object corresponding to the first display position as a reference, when an operation is received, via an operation portion, to arrange a pattern image with respect to the target object image for which the display position is set, the pattern image being an image representing the embroidery pattern.

4. The sewing system according to claim 1, wherein the sewing machine further includes an operation portion configured to receive an operation, and when acquiring the relative movement amount of the embroidery frame, the sewing machine acquires the movement amount of the embroidery frame in accordance with receiving, via the operation portion, an operation to move the embroidery frame using the movement mechanism, for aligning the reference point with the notification position.

5. The sewing system according to claim 4, wherein the computer-readable instructions stored in the memory of the sewing machine further cause the processor of the sewing machine to perform a process comprising:

moving the embroidery frame, using the movement mechanism, to move the reference point of the embroidery frame held by the movement mechanism closer to the notification position indicated by the notification portion, on the basis of the reference point coordinates included in the received first data; and after the movement of the embroidery frame by the movement mechanism, when acquiring the relative movement amount of the embroidery frame, acquiring the movement amount of the embroidery frame in accordance with receiving the operation to move the embroidery frame, using the movement mechanism, for aligning the reference point with the notification position.

6. The sewing system according to claim 1, wherein the notification portion includes a light irradiating portion that irradiates light onto the notification position.

7. The sewing system according to claim 1, wherein the first data transmitted by the device to the sewing machine further includes at least a part of the image, the sewing machine further includes a sewing machine display portion, and the computer-readable instructions stored in the memory of the sewing machine further cause the processor of the sewing machine to perform a process comprising:

displaying, on the sewing machine display portion, an image based on the at least part of the image included in the first data received from the device, and a pattern image, the pattern image being an image representing the embroidery pattern.

8. The sewing system according to claim 1, wherein when identifying the reference point coordinates, the device identifies the reference point coordinates representing each of a plurality of reference points, when notifying the notification position, the sewing machine notifies, using the notification portion, a plurality of the notification positions corresponding to the reference point coordinates, when acquiring the relative movement amount of the embroidery frame, the sewing machine acquires a plurality of the movement amounts for each of the plurality of notification positions, and when deciding the deviation from the prescribed state, the sewing machine decides a deviation in a rotational direction, on the basis of relationships between the plurality of movement amounts and the reference point coordinates.

9. The sewing system according to claim 1, wherein the device further includes a terminal display portion, and the computer-readable instructions stored in the memory of the device further cause the processor of the device to perform processes comprising:

capturing, using the image sensor, a plurality of markers provided on the embroidery frame, and identifying, from the image by the image sensor, an inclination of an optical axis of the image sensor with respect to a sewing surface of the embroidery frame; and displaying the identified inclination of the optical axis using a posture indicator inside the terminal display portion, and, when the inclination of the optical axis of the image sensor with respect to the sewing surface of the embroidery frame is within a given angle, when identifying the reference point coordinates, identifying the reference point coordinates on the basis of the image captured by the image sensor.

10. The sewing system according to claim 1, wherein the computer-readable instructions stored in the memory of the device further cause the processor of the device to perform a process comprising:

transmitting, to the sewing machine, second data not including the reference point coordinates, and the computer-readable instructions stored in the memory of the sewing machine further cause the processor of the sewing machine to perform processes comprising:

storing the decided deviation in the memory;

receiving the second data transmitted by the device; and when the second data is received, acquiring the deviation stored in the memory, as the deviation from the prescribed state of the positional relationship between the inner frame of the embroidery frame and the movement mechanism holding the outer frame.

11. A sewing system capable of sewing an embroidery pattern on a sewing object, the sewing system comprising:

an image sensor;

a movement mechanism configured to hold and move an outer frame of an embroidery frame in a state in which the sewing object is clamped between the outer frame and an inner frame of an embroidery frame;

a processor; and a memory storing computer-readable instructions that, when executed by the processor, cause the processor to perform processes comprising:

identifying, on the basis of an image when the embroidery frame is captured by the image sensor, reference point coordinates representing a position of a reference point provided in a range prescribed by the inner frame;

notifying a notification position, using a notification portion, with respect to the range prescribed by the inner frame of the embroidery frame held by the movement mechanism;

acquiring a relative movement amount of the embroidery frame with respect to the notification portion, for aligning the notified notification position and the position of the reference point provided in the range prescribed by the inner frame of the embroidery frame in the state of being held by the movement mechanism; and deciding, on the basis of a relationship between the acquired movement amount and the identified reference point coordinates, a deviation from a prescribed state of a positional relationship between the inner frame of the embroidery frame and the movement mechanism holding the outer frame.

12. The sewing system according to claim 11, wherein the computer-readable instructions stored in the memory of the sewing system further cause the processor of the sewing system to perform a process comprising:

correcting a sewing position of the embroidery pattern in accordance with the decided deviation.

13. The sewing system according to claim 11, further comprising:

a display portion configured to display a target object image, the target object image being an image representing the sewing object, wherein the computer-readable instructions stored in the memory of the sewing system further cause the processor of the sewing system to perform processes comprising:

when the deviation is decided, setting a display position of the target object image, with respect to the display portion, at a second display position according with the deviation, from a first display position corresponding to a position of the target object using the prescribed state as a reference; and identifying a sewing position of the embroidery pattern using the position of the sewing object corresponding to the first display position as a reference, when an operation is received, via an operation portion, to arrange a pattern image with respect to the target object image for which the display position is set, the pattern image being an image representing the embroidery pattern.

14. The sewing system according to claim 11, wherein when acquiring the relative movement amount of the embroidery frame, the sewing system acquires the movement amount of the embroidery frame in accordance with receiving, via an operation portion, an operation to move the embroidery frame using the movement mechanism, for aligning the reference point with the notification position.

15. The sewing system according to claim 14, wherein the computer-readable instructions stored in the memory of the sewing system further cause the processor of the sewing system to perform processes comprising:

moving the embroidery frame, using the movement mechanism, to move the reference point of the embroidery frame held by the movement mechanism closer to the notification position indicated by the notification portion, on the basis of the identified reference point coordinates; and after the movement of the embroidery frame by the movement mechanism, when acquiring the relative movement amount of the embroidery frame, acquiring the movement amount of the embroidery frame in accordance with receiving the operation to move the embroidery frame using the movement mechanism, for aligning the reference point with the notification position.

16. The sewing system according to claim 11, wherein the notification portion includes a light irradiating portion that irradiates light onto the notification position.

17. The sewing system according to claim 11, wherein when identifying the reference point coordinates, the reference point coordinates representing each of a plurality of reference points are identified, when notifying the notification position, a plurality of the notification positions corresponding to the reference point coordinates are notified, using the notification portion, when acquiring the relative movement amount of the embroidery frame, a plurality of the movement amounts for each of the plurality of notification positions are acquired, and when deciding the deviation from the prescribed state, a deviation in a rotational direction is decided, on the basis of relationships between the plurality of movement amounts and the reference point coordinates.

18. A sewing machine capable of sewing an embroidery pattern on a sewing object, the sewing machine comprising:

a movement mechanism configured to hold and move an outer frame of an embroidery frame in a state in which the sewing object is clamped between the outer frame and an inner frame of the embroidery frame;

a processor; and a memory storing computer-readable instructions that, when executed by the processor, cause the processor to perform processes comprising:

acquiring reference point coordinates representing a position of a reference point provided in a range prescribed by the inner frame of the embroidery frame;

notifying a notification position, using a notification portion, with respect to the range prescribed by the inner frame of the embroidery frame held by the movement mechanism;

acquiring a relative movement amount of the embroidery frame with respect to the notification portion, for aligning the notified notification position and the position of the reference point provided in the range prescribed by the inner frame of the embroidery frame in the state of being held by the movement mechanism; and deciding, on the basis of a relationship between the acquired movement amount and the acquired reference point coordinates, a deviation from a prescribed state of a positional relationship between the inner frame of the embroidery frame and the movement mechanism holding the outer frame.

19. The sewing machine according to claim 18, wherein the computer-readable instructions stored in the memory of the sewing machine further cause the processor of the sewing machine to perform a process comprising: correcting a sewing position of the embroidery pattern in accordance with the decided deviation.

20. The sewing machine according to claim 18, further comprising:

a sewing machine display portion configured to display a target object image, the target object image being an image representing the sewing object, wherein the computer-readable instructions stored in the memory of the sewing machine further cause the processor of the sewing machine to perform processes comprising:

when the deviation is decided, setting a display position of the target object image, with respect to the sewing machine display portion, at a second display position according with the deviation, from a first display position corresponding to a position of the target object using the prescribed state as a reference; and identifying a sewing position of the embroidery pattern using the position of the sewing object corresponding to the first display position as a reference, when an operation is received, via an operation portion, to arrange a pattern image with respect to the target object image for which the display position is set, the pattern image being an image representing the embroidery pattern.

21. The sewing machine according to claim 18, wherein when acquiring the relative movement amount of the embroidery frame, the movement amount of the embroidery frame is acquired in accordance with receiving, via an operation portion, an operation to move the embroidery frame using the movement mechanism, for aligning the reference point with the notification position.

22. The sewing machine according to claim 21, wherein the computer-readable instructions stored in the memory of the sewing machine further cause the processor of the sewing machine to perform processes comprising:

moving the embroidery frame, using the movement mechanism, to move the reference point of the embroidery frame held by the movement mechanism closer to the notification position indicated by the notification portion, on the basis of the acquired reference point coordinates; and after the movement of the embroidery frame by the movement mechanism, when acquiring the relative movement amount of the embroidery frame, acquiring the movement amount of the embroidery frame in accordance with receiving the operation to move the embroidery frame using the movement mechanism, for aligning the reference point with the notification position.

23. The sewing machine according to claim 18, wherein the notification portion includes a light irradiating portion that irradiates light onto the notification position.

24. The sewing machine according to claim 18, wherein when identifying the reference point coordinates, the reference point coordinates representing each of a plurality of reference points are identified, when notifying the notification position, a plurality of the notification positions corresponding to the reference point coordinates are notified, using the notification portion, when acquiring the relative movement amount of the embroidery frame, a plurality of the movement amounts for each of the plurality of notification positions are acquired, and when deciding the deviation from the prescribed state, a deviation in a rotational direction is decided, on the basis of relationships between the plurality of movement amounts and reference point coordinates.

* * * * *